US007410240B2

(12) United States Patent
Kadomatsu et al.

(10) Patent No.: US 7,410,240 B2
(45) Date of Patent: Aug. 12, 2008

(54) INKJET RECORDING HEAD AND INKJET RECORDING APPARATUS

(75) Inventors: Tetsuzo Kadomatsu, Kanagawa (JP); Masaaki Konno, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 425 days.

(21) Appl. No.: 11/070,095

(22) Filed: Mar. 3, 2005

(65) Prior Publication Data

US 2005/0200676 A1 Sep. 15, 2005

(30) Foreign Application Priority Data

Mar. 4, 2004 (JP) ..... 2004-060743
Mar. 10, 2004 (JP) ..... 2004-067765

(51) Int. Cl.
*B41J 2/135* (2006.01)
*B41J 29/38* (2006.01)
*B41J 2/175* (2006.01)

(52) U.S. Cl. ..... 347/44; 347/6; 347/85

(58) Field of Classification Search ..... 347/6, 347/44, 84, 85, 65, 21, 102
See application file for complete search history.

(56) References Cited

U.S. PATENT DOCUMENTS 5,712,667 A * 1/1998 Sato ..... 347/7
5,760,806 A * 6/1998 Oda et al. ..... 347/87
5,821,959 A * 10/1998 Murakami et al. ..... 347/47
5,912,689 A * 6/1999 Otsuka et al. ..... 347/86
5,969,736 A * 10/1999 Field et al. ..... 347/85
6,003,985 A * 12/1999 Bekki ..... 347/86
6,033,049 A * 3/2000 Fukuda ..... 347/20
6,179,415 B1 * 1/2001 Okazaki et al. ..... 347/86
6,505,923 B1 * 1/2003 Yamamoto et al. ..... 347/85
6,517,198 B2 * 2/2003 Yoshihira et al. ..... 347/87
6,520,630 B1 * 2/2003 Oda et al. ..... 347/85

FOREIGN PATENT DOCUMENTS

JP 60-132767 A 7/1985
JP 63-41152 A 2/1988
JP 2000-225695 A 8/2000
JP 2000-301716 A 10/2000
JP 2000-301730 A 10/2000
JP 2003-191470 A 7/2003
JP 2003-276256 A 9/2003
JP 2003-341028 A 12/2003
JP 2004-9469 A 1/2004
JP 2004-042548 A 2/2004
JP 2004-174846 A 6/2004

* cited by examiner

*Primary Examiner*—Stephen D Meier
*Assistant Examiner*—Leonard S Liang
(74) *Attorney, Agent, or Firm*—Birch, Stewart, Kolasch & Birch, LLP

(57) ABSTRACT

An inkjet recording head including first and second supply paths. The first supply path supplies ink to the pressure chamber. The second supply path supplies ink to the porous member. Also included is an orifice plate having the ink discharge port, where at least an inner wall of the ink discharge port is made from the porous member capable of being impregnated with ink. A pressure control device controls pressure of the ink to satisfy the equation $P1<P2\leqq P0$, where P1 is the pressure of the ink at a meniscus surface inside the ink discharge port, P2 is the pressure of the ink at a surface of the porous member forming the inner wall of the ink discharge port, and P0 is an atmospheric pressure.

3 Claims, 12 Drawing Sheets

INKJET RECORDING HEAD AND INKJET RECORDING APPARATUS

BACKGROUND OF THE INVENTION

1. Field of the Invention

The present invention relates to an inkjet recording head and an inkjet recording apparatus, and in particularly, relates to a maintenance technology for an inkjet recording head, which performs recording by discharging ink from a nozzle onto a recording medium.

2. Description of the Related Art

Inkjet recording apparatuses (inkjet printers) are widely used because the inkjet recording apparatuses are relatively inexpensive, simple to handle, and capable of producing images of high quality. A commonly used inkjet recording apparatus comprises an inkjet recording head (a print head) having a plurality of nozzles, and discharges ink from the nozzles onto a record paper to perform printing. Hence, if the viscosity of the ink increases or the ink hardens due to the evaporation of the solvent or the like, then blocking of the nozzles may occur and it may become difficult to achieve the ink discharge. In the light of the circumstances, various proposals have been made with a view to preventing the blocking of nozzles by improving the ink, namely, by adding an agent for moisture retention to a water-based ink, and using a high-boiling-point solvent in the case of an oil-based ink.

If ink of this kind is used, then when printing onto a record paper of low permeability is performed, the ink takes a long time to dry. Hence, the bleeding and color mixture of the ink may arise and a printed surface being still wet may touch components of the main unit of the printer, consequently, the printed image may deteriorate in quality. In view of preventing such the deterioration of the image quality, Japanese Patent Application Publication No. 60-132767 discloses an inkjet recording apparatus in which ultraviolet-curable ink is used and the ink is caused to set by irradiating ultraviolet light immediately after discharging the ink onto the record paper.

Moreover, in view of preventing blocking of the nozzles, Japanese Patent Application Publication No. 2000-301730 discloses an inkjet recording apparatus in which the nozzles are sealed by a sealing liquid containing a coloring agent of a similar color hue to the ink discharged from the nozzles, in such a manner that drying of the ink is prevented. A method for preventing increase in viscosity of the ink by capping the meniscus surface by means of the sealing liquid in this way does not incur the wasteful ink consumption and the reduced printing speed that are described below. However, adverse effects on ink discharge and ink composition may result because the ink droplets make contact with the sealing liquid when they are discharged from the nozzles onto the recording medium. Hence, in Japanese Patent Application Publication No. 2000-301730, effects of this kind are prevented by using a sealing liquid containing a coloring agent of a similar color hue to the ink.

Furthermore, the nozzle is filled with ink at all times in order that printing can be implemented immediately whenever a printing command is issued. Hence, at the meniscus surface of the ink in the vicinity of the opening section of the nozzle, the solvent in the ink is liable to evaporate and hence the ink is liable to increase in viscosity. If the ink at the meniscus surface reaches a state of increased viscosity, then this may incur the discharge defects of the nozzles. If the evaporation continues further, then the ink component becomes a film-like form at the meniscus surface, and thereby it incurs discharge defects that are even harder to recover.

Thus, the meniscus surface should be kept at all times in a state that does not incur an increase in viscosity.

Hence, a device for mechanically capping the nozzles, or the like, is used in order to prevent increase in viscosity of ink at the meniscus surface, in the case where a printing operation is not carried out for a long period of time, for instance, if the power supply is switched off.

On the other hand, in order to be able to carry out printing immediately if a print command is issued; it is preferable for the nozzles to be in an uncapped state during printing or during standby. Even if an inkjet recording head is provided with a plurality of nozzles, not all of the nozzles necessarily discharge ink during a printing operation, and hence the nozzle having a low ink discharge frequency may arise depending on the image data used to perform printing. In the case of a nozzle having a low ink discharge frequency, which continues in a state of not discharging ink for a certain period of time or more, the solvent in the ink in the vicinity of the meniscus surface evaporates and the viscosity of the ink increases. When a state of this kind occurs, it is difficult to discharge ink from the nozzle and hence discharge defects of the nozzles may occur.

Hence, in order to prevent discharge defects at a nozzle due to the increase in viscosity of the ink at the meniscus surface, a refresh operation, such as a preliminary discharge (e.g., "purge", "blank discharge", "liquid discharge", or the like), is carried out periodically so that the degraded ink with increased viscosity is discharged. However, while the refresh operation is effective in preventing discharge defects in nozzles due to the ink with increased viscosity in the vicinity of the meniscus surface, the refresh operation requires consuming ink wastefully. Moreover, printing cannot be carried out during the refresh operation, and hence printing speed is reduced. If the number of refresh operations is lowered in order to maintain printing speed, then it may be difficult to satisfactorily prevent the increased viscosity of the ink at the meniscus surface.

Furthermore, in order to prevent nozzle blockages due to the increased viscosity of the ink, an ink vibration method is also known in which the meniscus of the ink is caused to vibrate by a piezoelectric element or the like. This method is able to suppress the wasteful consumption of ink, but it requires control for vibrating the meniscus surface and may be inherently unsuited to prevent the discharge defects.

Hence, Japanese Patent Application Publication No. 2003-191470 discloses an inkjet recording head that supplies a moisture retention liquid or ink to the meniscus surface, in order to prevent increase in viscosity of the ink at the meniscus surface when the mechanical capping of the nozzles is removed. In the inkjet recording head, an orifice plate formed with a nozzle is made from a porous member which can be impregnated with ink, and by supplying the moisture retention liquid or ink to the porous member, the ink in the vicinity of the meniscus is kept in a wet state and increase in viscosity of the ink at the meniscus surface is prevented. Furthermore, the inkjet recording head is also designed to prevent increase in viscosity of the ink at the meniscus surface by periodically suctioning the ink with increased viscosity in the vicinity of the meniscus surface via the orifice plate.

However, in the inkjet recording apparatus using conventional ultraviolet-curable type ink as described in Japanese Patent Application Publication No. 60-132767, in order to suppress the image deterioration, such as bleeding of the image or spreading of the dots, it is desirable to irradiate ultraviolet light at the earliest possible timing after discharging the ink, and hence it requires to position the ultraviolet irradiation source as closely as possible to the nozzle. However, if the light source is positioned close to the nozzle, then the luminous energy of scattered ultraviolet light arriving at the nozzle increases and hence the ink inside the nozzle is liable to harden and cause a nozzle blockage.

Moreover, in the inkjet recording apparatus described in Japanese Patent Application Publication No. 2000-301730, drying of the ink is prevented by sealing the nozzle with the sealing liquid, but it is difficult to prevent the ultraviolet-curable ink inside the nozzle from hardening due to the scattered ultraviolet light.

In this way, there still has not been proposed a technique that completely shields the ink inside the nozzle from the scattered light when the radiation-curable ink, such as an ultraviolet-curable ink, is used. Hence, there is a requirement to develop an inkjet recording apparatus that prevents nozzle blockages due to scattered light or the like when a radiation-curable ink is used.

Furthermore, in the inkjet recording head described in Japanese Patent Application Publication No. 2003-191470, the supply of the moisture retention liquid or the like to the meniscus surface is performed on the basis of capillary action. Therefore, when the use frequency of a nozzle is high, the moisture retention liquid or the like seeps out to the meniscus surface via the porous member of the orifice plate immediately after the ink discharge, and hence sufficient moisture retention liquid or the like is supplied to the meniscus and the meniscus surface can be maintained sufficiently in a wet state. However, if the use frequency of the nozzle falls, then the fluidity of the ink declines, the supply of moisture retention liquid or the like to the meniscus surface by means of capillary action through the porous member become more difficult, and it is difficult to maintain the meniscus surface in a wet state. Hence, the ink at the meniscus surface evaporates and becomes a state of increased viscosity, which may lead to discharge defects at the nozzle.

Furthermore, concerning the inkjet recording head described above, a method is proposed in which, if the meniscus surface increases in viscosity due to the decline in fluidity of the ink, then the ink with the increased viscosity at the meniscus surface is suctioned periodically via the orifice plate. However, similarly to the above-mentioned refresh operation, such as preliminary discharge, printing may not be performed during the suctioning of the ink and hence the printing speed may decline. In other words, if the number of the suctioning operations is reduced in order to ensure printing speed, it is difficult to sufficiently prevent increase in viscosity of the ink at the meniscus surface.

In this way, no inkjet recording head has yet been proposed which comprises a viscosity-increase-preventing-device giving a good wetting effect to the ink at the meniscus surface even when the fluidity of the ink has declined. In the light of the circumstances, there is a requirement to develop a viscosity-increase-preventing-device that provides a wetting effect for the ink at all times.

SUMMARY OF THE INVENTION

The present invention has been made in view of foregoing circumstances, and it is an object of the present invention to prevent the nozzle blockage. Another object of the present invention is to provide an inkjet recording apparatus using a radiation-curable ink, such as ultraviolet-curable ink, which can prevent the occurrence of the nozzle blockage caused by hardening the radiation-curable ink inside the nozzle due to the scattering of the light irradiated onto the discharged ink in order to harden the discharged ink. Another object of the present invention is to provide an inkjet recording head and an inkjet recording apparatus that can prevent increase in viscosity of the liquid at the meniscus surface by constantly supplying liquid to the meniscus surface.

In order to attain the aforementioned object, the present invention is directed to an inkjet recording apparatus, comprising: an ink discharge port which discharges radiation-curable ink; a radiation irradiating unit which causes the radiation-curable ink discharged from the ink discharge port to set; and a sealing liquid which seals the ink discharge port, wherein the sealing liquid absorbs or reflects radiation whose wavelength falls within a specific wavelength range.

According to the present invention, in the inkjet recording apparatus, it is possible to shut out light completely from the meniscus surface of the radiation-curable ink inside a nozzle, by means of the sealing liquid provided at the ink discharge port. Hence, it is possible to prevent nozzle blockages caused by the scattered light generated by the radiation-irradiation by means of the radiation irradiating unit.

In the present specification, the term "radiation" stands for the concept of radiation in a broad sense, including infrared light, ultraviolet light, electron beams, X rays, and electromagnetic beams.

For example, the radiation-curable ink is an ultraviolet-curable ink; and the radiation irradiating unit includes an ultraviolet irradiating unit. According to this, the ultraviolet-curable ink discharged from the ink discharge port is caused to harden by being irradiated with ultraviolet light from the ultraviolet irradiating unit.

Preferably, the sealing liquid is supplied to the ink discharge port from a flow path made from a porous member. According to this, since the flow path for the sealing liquid is made from the porous member, the inkjet recording apparatus does not require fabrication of complicated flow paths, and can be manufactured readily and inexpensively.

Preferably, the sealing liquid may be transparent. Alternatively, the sealing liquid may have a color similar to the color tone of the radiation-curable ink. According to this, since the ink discharge port is covered with the sealing liquid, the radiation-curable ink is discharged through the sealing liquid and the sealing liquid may adhere to the record paper together with the radiation-curable ink. However, since the sealing liquid is transparent or of a similar color to the color tone of the radiation-curable ink, the adverse effects, such as smearing the ink adhering to the record paper, are prevented.

Preferably, a film thickness of the sealing liquid that seals the ink discharge port is 5 μm to 50 μm. It is preferable that the film thickness of the sealing liquid is set to this range, in order that the radiation-curable ink can be discharged through the sealing liquid which seals the ink discharge port, the sealing liquid does not significantly affect the ink discharge characteristics (e.g., direction of flight, droplet volume, and the like), and the sealing liquid can shut out the scattered light completely.

Preferably, the radiation irradiating unit emits a pulsed radiation in synchronization with the radiation-curable ink discharged from the ink discharge port. According to this, since the radiation irradiating unit does not emit the pulsed radiation when the shielding is removed during the ink discharge, nozzle blockages are prevented. Furthermore, the present invention makes it possible that the pulsed radiation having a stronger intensity than normal can be emitted momentarily, and hence the curing performance of the radiation-curable ink is improved.

Preferably, the inkjet recording apparatus further comprises a radiation-irradiating-unit-drive-control-device which generates an irradiation signal delayed by a prescribed delay time from an ink discharge signal for discharging the radiation-curable ink, the radiation-irradiating-unit-drive-control-device setting the prescribed delay time according to at least one of a film thickness of the sealing liquid that seals the ink discharge port, kinematic viscosity of the sealing liquid, surface tension of the sealing liquid, and a positional relationship between the ink discharge port and the radiation irradiating unit.

According to the present invention, by means of the radiation-irradiating-unit-drive-control-device generating an irradiation signal delayed by the prescribed delay time from the ink discharge signal, it is possible to emit a pulsed radiation in synchronization with the radiation-curable ink discharge, and hence nozzle blockages are prevented. Furthermore, the present invention makes it possible that the pulsed radiation having a stronger intensity than normal can be emitted momentarily, and hence the curing performance of the radiation-curable ink is improved.

In order to attain the aforementioned object, the present invention is also directed to an inkjet recording head, comprising: a pressure chamber communicating with an ink supply port and an ink discharge port; a first supply path which supplies an ink to the pressure chamber via the ink supply port; an orifice plate including the ink discharge port, at least an inner wall of the orifice plate being made from a porous member capable of being impregnated with the ink; and a second supply path which supplies the ink to the porous member, wherein a pressure P1 of the ink supplied to the pressure chamber from the first supply path, a pressure P2 of the ink supplied to the porous member from the second supply path, and an atmospheric pressure P0 satisfy the following expression: $P1<P2\leqq P0$.

According to the present invention, in the inkjet recording head, by setting the pressure P2 of the ink that is supplied to the meniscus surface from the second supply path via the porous member, to a greater pressure than the pressure P1 of the ink that is supplied from the first supply path, and by setting the pressure P2 to a pressure not more than the atmospheric pressure P0, it is possible to achieve a low-speed flow of ink in which new ink is supplied constantly from the second supply path to the meniscus surface, and the supplied ink moves toward the ink discharge side and goes with the flow in the main flow path without the ink spilling out from the ink discharge port. Hence, increase in the viscosity of the ink at the meniscus surface can be prevented.

Preferably, the inkjet recording head further comprises a pressure control device which controls the pressure P1 of the ink supplied from the first supply path and the pressure P2 of the ink supplied from the second supply path. According to this, since it is possible to alter the flow speed of the ink supplied from the second supply path by controlling the pressures P1 and P2 by means of the pressure control device, then even if ink has not been discharged for a long period of time and the fluidity of the ink has declined, it is still possible to prevent increase in viscosity of the ink at the meniscus surface by generating a relatively rapid ink flow.

Preferably, the pressure control device includes at least one of a device which adjusts a relative height of an ink surface in a tank storing the ink with respect to the inkjet recording head, and a pump. According to this, it is possible to control the respective pressures P1 and P2 by driving the pump, or by driving the device which adjusts the relative height of the ink surface in the first tank storing the ink with respect to the inkjet recording head and/or the relative height of the ink surface in the second tank storing the ink with respect to the inkjet recording head. Hence, beneficial effects similar to those described above can be obtained.

In order to attain the aforementioned object, the present invention is also directed to an inkjet recording apparatus comprising the inkjet recording head as described above.

According to a certain aspect of this invention, since the inkjet recording apparatus comprises the sealing liquid that is provided at the ink discharge port and absorbs or reflects radiation whose wavelength falls within the specific wavelength range, the radiation can be shut out completely from the meniscus surface of the ink. Hence, it is possible to prevent the occurrence of nozzle blockages due to the scattered light or the like, generated by the irradiation of radiation onto the ultraviolet-curable ink from the radiation irradiating unit.

Furthermore, according to another aspect of this invention, by setting the pressure P2 of the ink that is supplied to the meniscus surface from the second supply path via the porous member, to a greater pressure than the pressure P1 of the ink supplied from the first supply path, and by setting the pressure P2 to a pressure equal to or less than the atmospheric pressure P0, it is possible to achieve the low-speed flow of ink in which new ink is supplied constantly from the second supply path to the meniscus surface, and the supplied ink moves toward the ink discharge side and goes with the flow in the main flow path without the ink spilling out from the ink discharge port. Hence, increase in the viscosity of the ink at the meniscus surface can be prevented.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
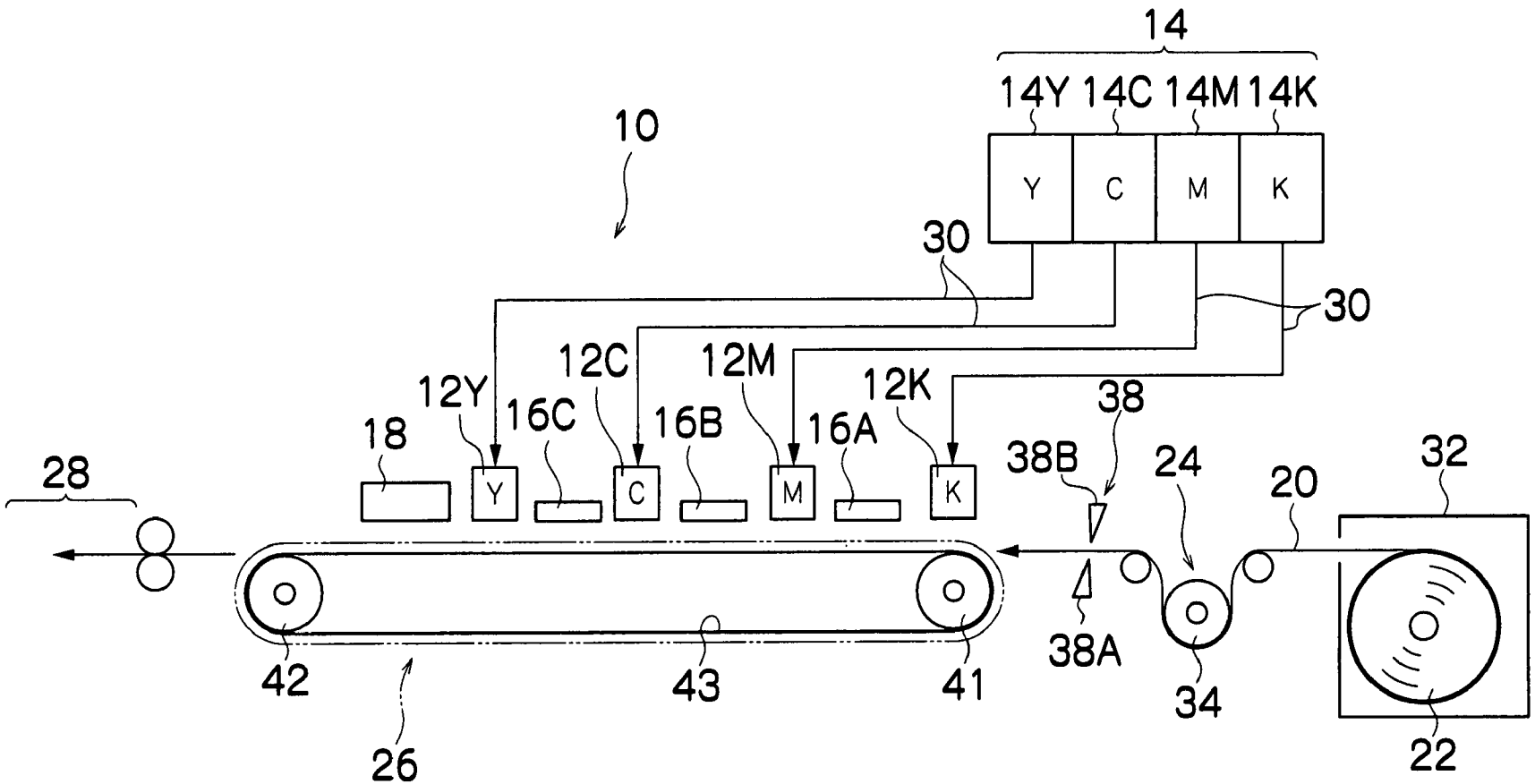
FIG. 1 is a general schematic drawing of an inkjet recording apparatus according to a first embodiment of the present invention.

FIG. 1 is a diagram of the general composition of an inkjet recording apparatus relating to a first embodiment of the present invention. As shown in FIG. 1, this inkjet recording apparatus 10 comprises: a plurality of print heads 12K, 12M, 12C and 12Y provided corresponding to respective ink colors of black (K), magenta (M), cyan (C), and yellow (Y); an ink storing and loading unit 14 for storing ultraviolet (UV) curable ink to be supplied to the print heads 12K, 12M, 12C and 12Y; ultraviolet irradiating units 16A, 16B and 16C disposed between the respective print heads; a main fixing unit 18 disposed after the print head 12Y with final color ink; a paper supply unit 22 for supplying a record paper 20 as a recording medium; a decurling unit 24 for removing curl in the record paper 20; a suction belt conveyance unit 26 for conveying the record paper 20 while keeping the record paper 20 flat, the suction belt conveyance unit 26 disposed facing the nozzle faces (ink discharge faces) of the print heads 12K, 12M, 12C, 12Y, the ultraviolet irradiating units (16A, 16B and 16C), and the main fixing unit 18; and a paper output unit 28 for outputting the recorded record paper (printed matter) to the exterior.

The ultraviolet-curable ink is an ink containing a component which hardens (polymerizes) upon application of ultraviolet energy (e.g., an ultraviolet-curable component, such as a monomer, oligomer, or a low-molecular-weight homopolymer, copolymer, or the like), and a polymerization initiator. The ink therefore has a property whereby, when ultraviolet light is irradiated onto the ink, the ink starts to polymerize, and the viscosity of the ink increases and finally it hardens as the polymerization progresses.

The ink storing and loading unit 14 has ink tanks 14K, 14M, 14C and 14Y for storing the inks of the colors corresponding to the print heads 12K, 12M, 12, and 12Y, and the tanks communicate with the print heads 12K, 12M, 12C and 12Y through prescribed channels 30. The ink storing and loading unit 14 has a warning device (for example, a display device or an alarm sound generator) for warning when the remaining amount of any ink is low, and has a mechanism for preventing loading errors among the colors.

In FIG. 1, a single magazine 32 for rolled paper (continuous paper) is shown as an example of the paper supply unit 22, however, a plurality of magazines with paper differences, such as paper width and quality, may be placed side by side. Moreover, papers may be supplied by a cassette that contains cut papers loaded in layers and that is used in combination with or in lieu of a magazine for a rolled paper.

In the case of a configuration in which a plurality of types of record paper can be used, it is preferable that an information recording medium, such as a bar code and a wireless tag, containing information about the type of paper is attached to the magazine, and by reading the information contained in the information recording medium with a predetermined reading device, the type of paper to be used is automatically determined, and ink droplet discharge is controlled so that the ink droplets are discharged in an appropriate manner in accordance with the type of paper.

The record paper 20 delivered from the paper supply unit 22 retains curl due to having been loaded in the magazine 32. In order to remove the curl, in the decurling unit 24, heat is applied to the record paper 20 by a heating drum 34 in the direction opposite to the curl direction in the magazine 32. In this case, the heating temperature is preferably controlled so that the surface on which the print is to be made is slightly rounded in the outward direction.

In the case of a configuration in which roll paper is used, a cutter 38 is provided as shown in FIG. 1, and the roll paper is cut to be a desired size by the cutter 38. The cutter 38 has a stationary blade 38A having a length no less than the width of the conveyance path for the record paper 20, and a round blade 38B that moves along the stationary blade 38A. The stationary blade 38A is disposed on the reverse side of the printed surface of the record paper 20, and the round blade 38B is disposed on the printed surface side across the conveyance path from the stationary blade 38A. When cut paper is used, the cutter 38 is not required.

The decurled and cut record paper 20 is delivered to the suction belt conveyance unit 26. The suction belt conveyance unit 26 has a configuration in which an endless belt 43 is set around rollers 41 and 42 in such a manner that at least the portion of the endless belt 43 facing the nozzle faces of the print heads 12K, 12M, 12C and 12Y forms a horizontal plane (flat plane).

The belt 43 has a width that is greater than the width of the record paper 20, and a plurality of suction apertures (not shown) are formed on the belt surface. A suction chamber (not shown) is provided on the inner side of the belt 43 set about the rollers 41 and 42, and the record paper 20 is suctioned and held on the belt 43 by creating a negative pressure by means of sucking the suction chamber with a fan.

The drive force of a motor 88 (shown in FIG. 5) is transmitted to at least one of the rollers 41 and 42, around which the belt 43 is wound, thereby the belt 43 is driven in the counterclockwise direction in FIG. 1. Accordingly, the record paper 20 suctioned onto the belt 43 is conveyed from right to left in FIG. 1.

The print heads 12K, 12M, 12C and 12Y are full line heads having a length corresponding to the maximum width of the record paper 20 used with the inkjet recording apparatus 10, and comprising a plurality of nozzles for discharging ink arranged on a nozzle face along a length exceeding at least one edge of the maximum-size record paper 20 (namely, the full width of the printable range).

The print heads 12K, 12M, 12C and 12Y are arranged in the order of black (K), magenta (M), cyan (C), and yellow (Y) from the upstream side in the delivery direction of the record paper 20, and these respective print heads 12K, 12M, 12C and 12Y are fixed and extend in a direction substantially orthogonal to the conveyance direction of the record paper 20.

A color image can be formed on the record paper 20 by discharging inks of different colors from the print heads 12K, 12M, 12C and 12Y, respectively, onto the record paper 20 while the record paper 20 is conveyed by the suction belt conveyance unit 26.

By adopting the configuration in which full line heads 12K, 12M, 12C and 12Y having nozzles rows covering the full width of the paper are provided for each separate color in this way, it is possible to record an image on the full surface of the record paper 20 by means of performing just one operation of moving the record paper 20 relatively with respect to the print heads 12K, 12M, 12C and 12Y in the conveyance direction of the record paper 20 (i.e., the sub-scanning direction), (in other words, by means of one sub-scanning action). Such a single-pass type image forming apparatus of this kind is able to print at high speed in comparison with a shuttle scanning system in which an image is printed by moving a print head back and forth reciprocally in a direction orthogonal to the sub-scanning direction (i.e., main scanning direction), and may improve print productivity.

Although a configuration with the four standard colors KMCY is illustrated by an example in the present embodiment, the combinations of the ink colors and the number of colors are not limited to these. Light and/or dark inks, and special color inks can be added as required. For example, a configuration is possible in which print heads for discharging light-colored inks such as light cyan and light magenta are added.

The ultraviolet irradiating units 16A, 16B, and 16C disposed between the print heads have a length corresponding to the maximum width of the record paper 20, similarly to the print heads, and they are fixed and extend in a direction substantially orthogonal to the conveyance direction of the record paper 20. The ultraviolet irradiating units 16A, 16B, and 16C irradiate ultraviolet light having energy of a level that causes the ink discharged by the print head 12K, 12M or 12C situated adjacently on the upstream side of the irradiating unit to change to a semi-hardened state (a state where it is not completely hardened, or a semi-liquid state).

In other words, the ultraviolet irradiating units 16 have the function of semi-hardening the ink on the record paper 20 so as to prevent intermixing of inks, in such a manner that the ink deposited onto the record paper 20 by the preceding print head 12K, 12M or 12C does not mix on the record paper with ink of another color discharged from a subsequent print head 12M, 12C or 12Y, and does not induce bleeding.

After the record paper 20 has passed under an upstream print head unit and before it enters below the next print head, ultraviolet light is irradiated from the ultraviolet irradiating unit 16, thereby changing the state of the ink on the record paper 20 to the semi-hardened state, and then droplets of a different color is discharged by the subsequent print head.

The main fixing unit 18 is disposed after the yellow print head 12Y which is located on the furthest downstream position in the sub-scanning direction. The main fixing unit 18 irradiates ultraviolet light sufficient to cause the ink on the record paper 20 to harden completely, and hence it achieves complete fixing of the ink on the record paper 20.

In the example in FIG. 1, the droplets of magenta ink are discharged by the magenta print head 12M after the droplets of black ink have been discharged by the black print head 12K and the black ink has been semi-hardened by irradiation of ultraviolet light by the ultraviolet irradiating unit 16A. Similarly, the droplets of cyan ink are discharged by the cyan print head 12C after droplets of magenta ink have been discharged by the magenta print head 12M and have been irradiated with ultraviolet light by the ultraviolet irradiating unit 16B. Subsequently, droplets of yellow ink are discharged by the yellow print head 12Y after the cyan ink droplets have been irradiated with ultraviolet light by the ultraviolet irradiating unit 16C.

After droplets of yellow ink, which is the last color, have been discharged by the yellow print head 12Y, it is not necessary to irradiate ultraviolet light in order to semi-harden the ink, and therefore no ultraviolet irradiating unit 16 is provided here.

After passing the yellow print head 12Y, complete fixing is performed by irradiating ultraviolet light sufficient to cause the ink on the record paper 20 to harden completely by means of the main fixing unit 18.

The printed object made in this manner is output via the paper output unit 28. In spite of not shown in FIG. 1, the paper output unit 28 is provided with a sorter for collecting images according to print orders.

The state of hardening of the ink induced by the ultraviolet irradiating units 16A, 16B and 16C is not limited to a semi-hardened state, and complete fixing in which the ink is hardened completely may be performed.

Figure 2:
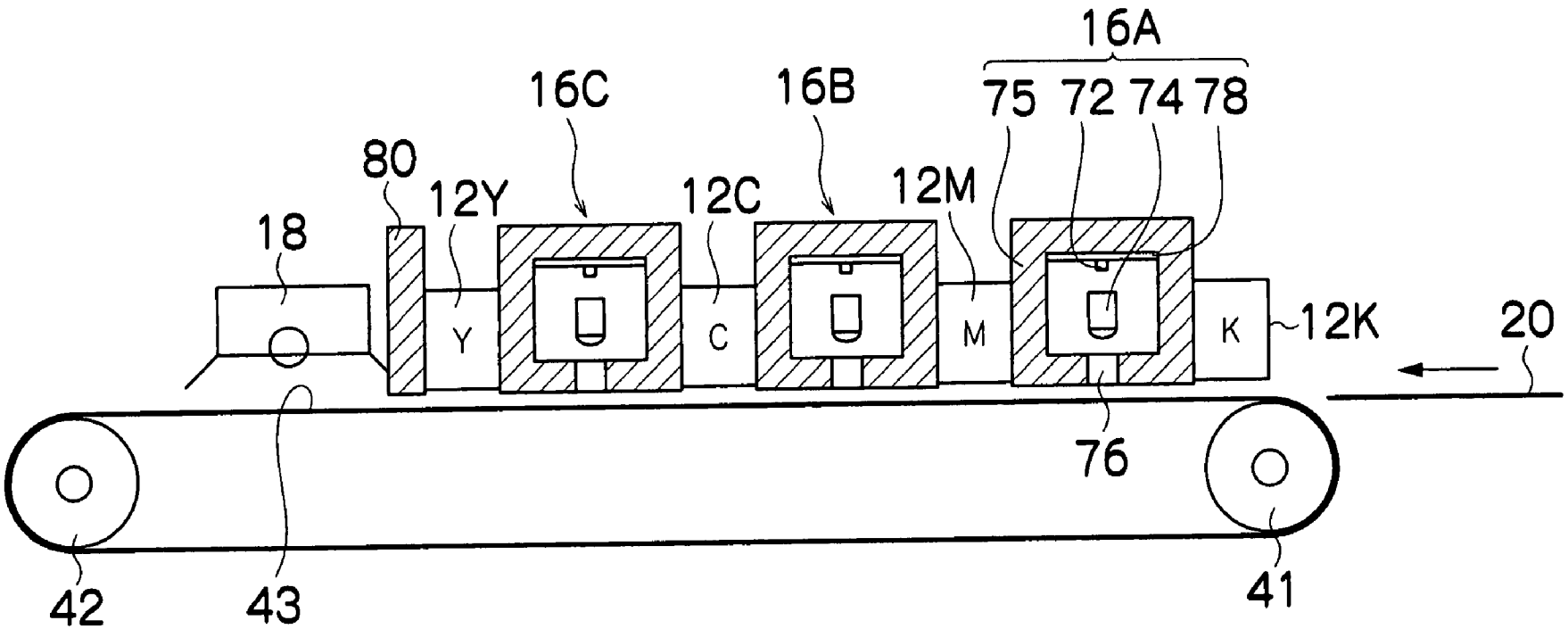
FIG. 2 is a compositional diagram showing an example of the structure of an ultraviolet irradiating unit.
Figure 6A:
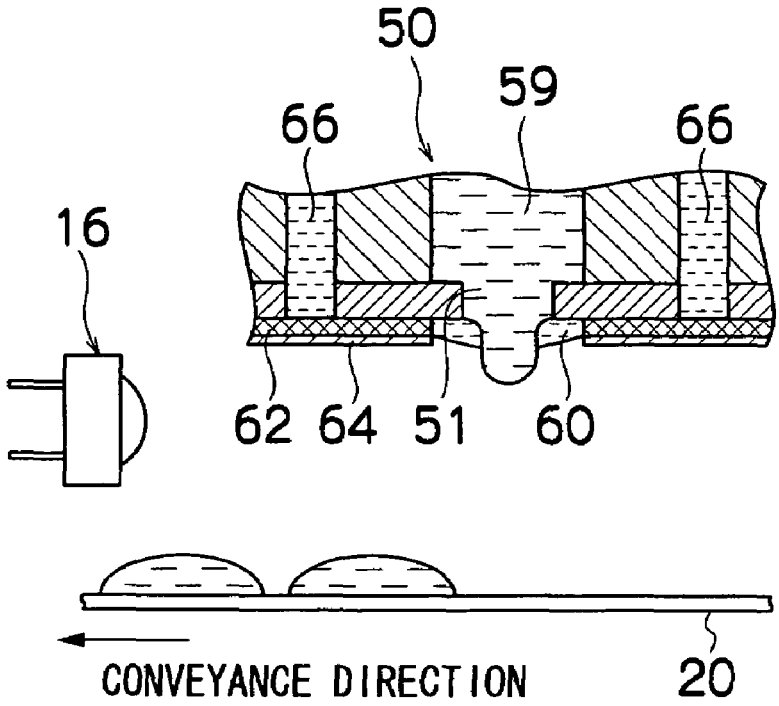
FIGS. 6A and 6B are diagrams showing the relationship between a nozzle and an ultraviolet irradiating unit.
Figure 6B:
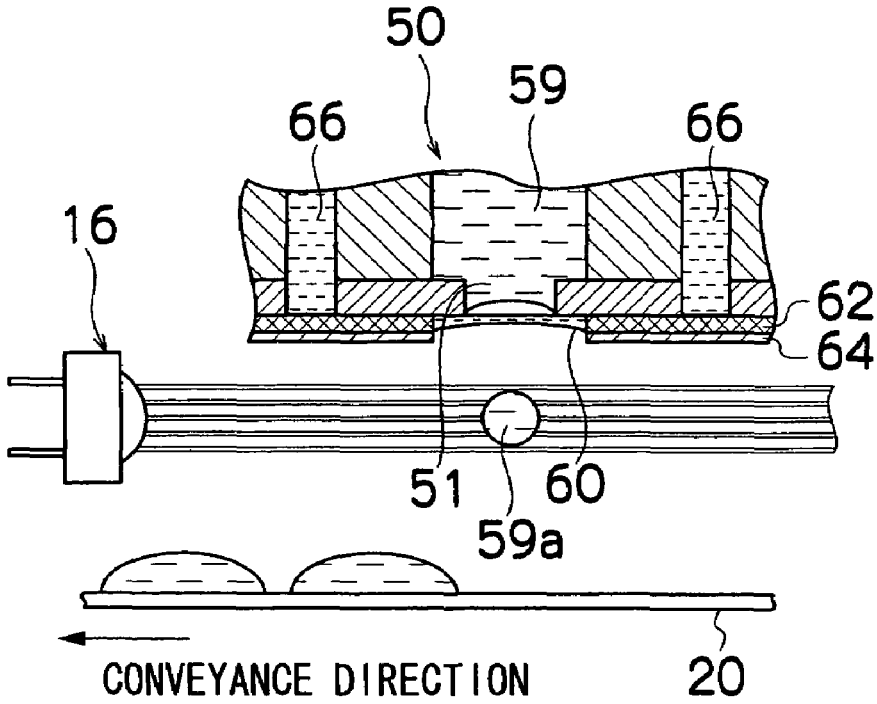

Next, a structural example of the ultraviolet irradiating unit is described. FIG. 2 is a compositional diagram showing an example of the structure of the ultraviolet irradiating units 16A, 16B and 16C. In FIG. 2, parts that are common to FIG. 1 are labeled with the same reference numerals. As shown in FIG. 2, each of the ultraviolet irradiating units 16A, 16B and 16C has a structure in which a linear ultraviolet LED element 72 and a lens system 74 are disposed inside a shielding container 75. The ultraviolet irradiating units 16A, 16B and 16C irradiate the condensed ultraviolet light having a linear shape onto the record paper 20 situated on the belt 43, via a slit-shaped opening section 76 formed in the base of the shielding container 75. The ultraviolet LED element 72 is supported by a substrate 78. The directions of irradiation of the ultraviolet light by the ultraviolet irradiating units 16A, 16B and 16C are not limited to the direction substantially orthogonal to the direction of conveyance of the record paper 20 as shown in FIG. 2, and it is also possible to adopt a composition in which the direction of the irradiation is parallel to the direction of the conveyance of the record paper 20, as shown in FIGS. 6A and 6B described hereinafter. Furthermore, a composition using LD (laser diode) elements instead of LED elements may also be adopted.

In FIG. 2, a mercury lamp, metal halide lamp, or the like, is suitable for use in the main fixing unit 18 positioned after the yellow print head 12Y. The light from the light source of the main fixing unit 18 has broader wavelength range and greater luminous energy than those of the ultraviolet LED elements 72. Furthermore, a shielding dividing member 80 for preventing the light irradiated from the main fixing unit 18 from entering into the yellow print head 12Y is provided between the yellow print head 12Y and the main fixing unit 18.

Next, the structure of the print head is described. The structures of the print heads 12K, 12M, 12C and 12Y provided for each of the ink colors are common, and a reference numeral 50 hereinafter stands for any of the print heads 12K, 12M, 12C and 12Y.

Figure 3A:
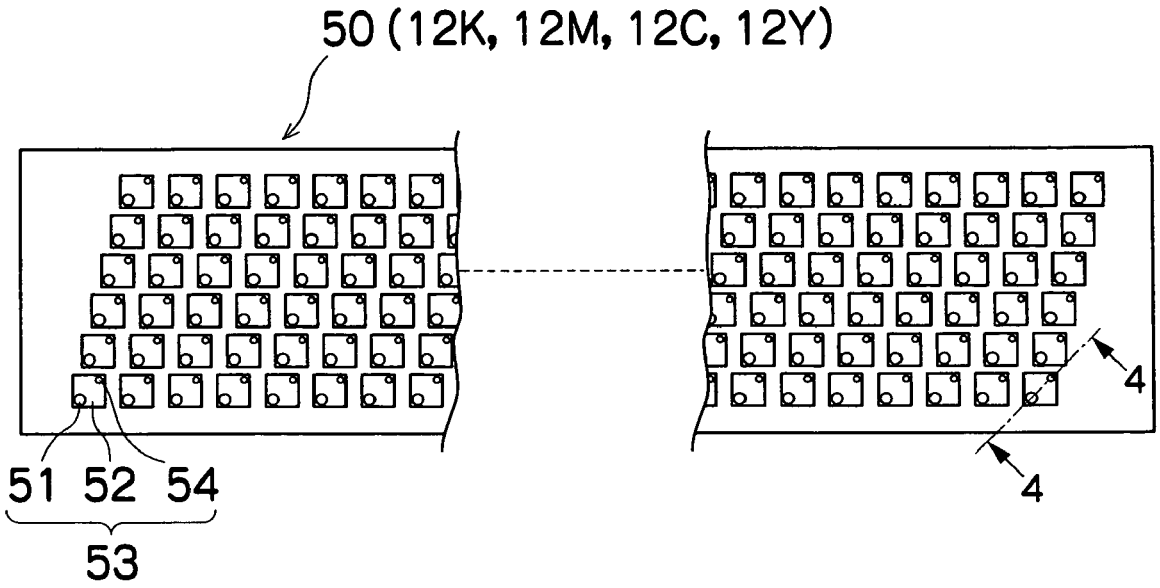
FIG. 3A is a planar perspective diagram showing an example of the structure of a print head.
Figure 3B:
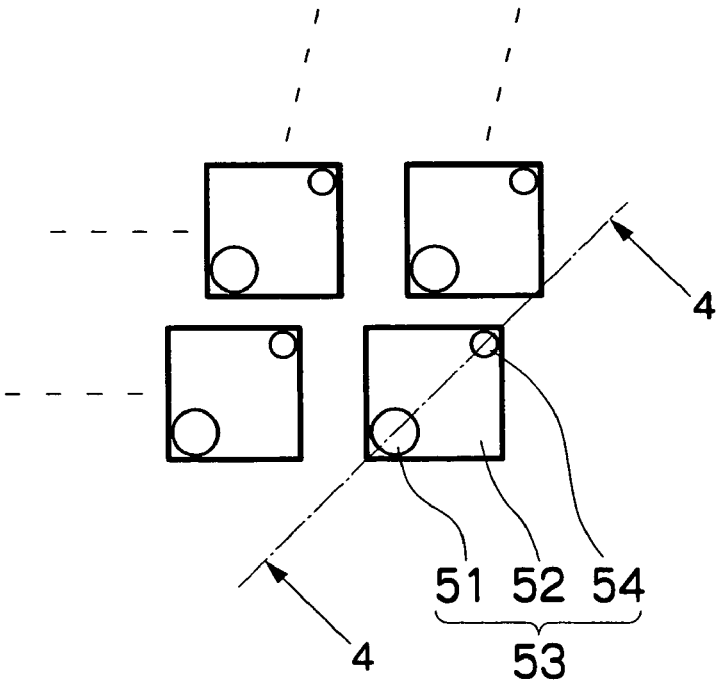
FIG. 3B is an enlarged view of a portion of FIG. 3A.
Figure 4:
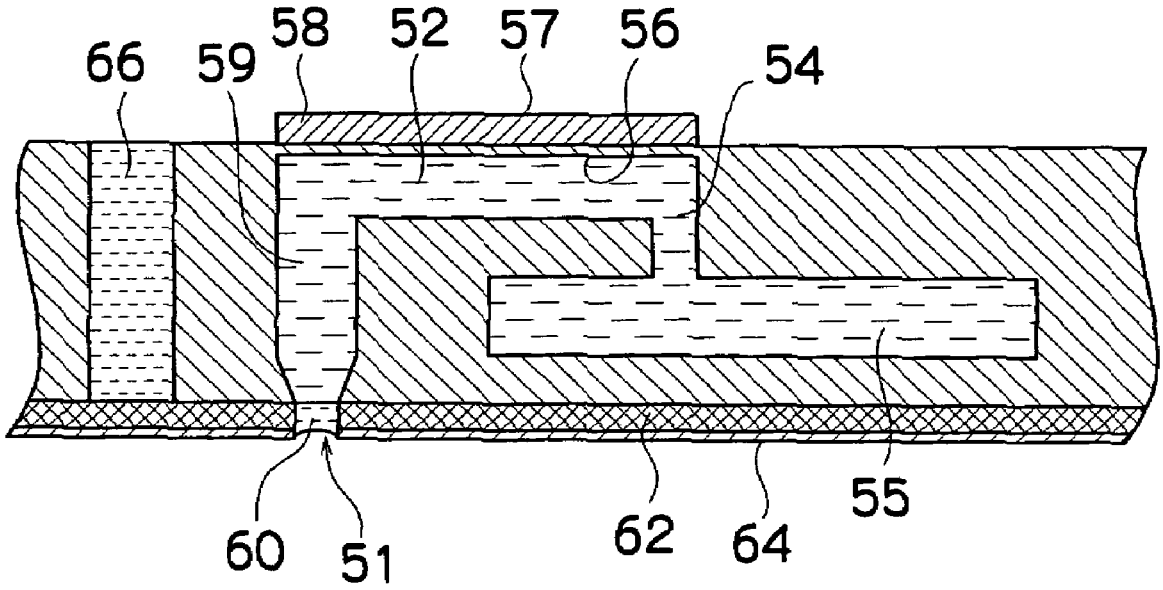
FIG. 4 is a cross-sectional diagram along a line 4-4 in FIGS. 3A and 3B.

FIG. 3A is a plan view perspective diagram showing an example of the composition of the print head 50, and FIG. 3B is an enlarged diagram of a portion of FIG. 3A. Furthermore, FIG. 4 is a cross-sectional diagram along line 4-4 in FIGS. 3A and 3B and shows the three-dimensional structure of an ink chamber unit 53. In order to achieve a high density of the dots printed onto the surface of the recording medium, it is necessary to achieve a high density of the nozzles by adjusting the nozzle pitch in the print head 50. As shown in FIGS. 3A, 3B and 4, the print head 50 in the present embodiment has a structure in which a plurality of ink chamber units 53, including nozzles 51 for discharging ink droplets and pressure chambers 52 corresponding to the nozzles 51, are disposed in the form of a staggered matrix, and thereby an apparent high density of the nozzles by adjusting the nozzle pitch is achieved.

The pressure chamber 52 provided corresponding to each of the nozzles 51 is approximately square-shaped in plan view, and a nozzle 51 and a supply port 54 are diagonally provided respectively at symmetrically situated corner sections of the pressure chamber 52. Each of the pressure chambers 52 is communicated with the common flow passage 55 via the supply port 54.

As shown in FIG. 4, an actuator 58 provided with an individual electrode 57 is joined to a pressure plate 56 which forms the upper face of the pressure chamber 52. When a drive voltage is applied to the individual electrode 57, the actuator 58 is deformed, thereby the ink 59 is discharged from the nozzle 51. When ink 59 has been discharged, new ink is supplied to the pressure chamber 52 from the common flow passage 55 via the supply port 54.

The nozzle 51 is sealed by a sealing liquid 60, and this sealing liquid 60 is supplied via a porous member 62 capable of being impregnated with a liquid, from a sealing liquid supply path 66 that communicates with the porous member 62. A coating layer 64, which is applied a surface treatment creating zero ink permeability to, is formed on the surface of the porous member 62 on the ink discharge side.

The sealing liquid 60 contains a substance that absorbs or reflects ultraviolet light. Examples of the substance for absorbing or reflecting the ultraviolet light are: inorganic UV absorbing (reflecting) agents, such as titanium oxide, cerium oxide, or zinc oxide; or organic UV absorbing agents, such as a benzotriazole, benzophenone, salicylate, or the like.

The sealing liquid 60 shields the scattered light generated by irradiation of ultraviolet light onto the ultraviolet-curable ink by means of the ultraviolet irradiating units 16 (not shown in FIG. 3, but indicated by reference numerals 16A, 16B and 16C in FIG. 2), and hence has the function of preventing nozzle blockages caused by the scattered light reaching the nozzles 51.

The sealing liquid 60 has ink repelling properties and does not mix with the ink. As a means for achieving the ink repelling properties, if the monomer forming the solvent component of the ultraviolet-curable ink has hydrophobic properties, then a water-based liquid is used as the sealing liquid 60, and if the monomer has hydrophilic properties, then minute particles are dispersed in an organic solvent.

The ultraviolet-curable ink 59 is discharged through the sealing liquid 60. It is preferable that the sealing liquid 60 have sufficient thickness to shut out the ultraviolet light. It is desirable that the film thickness of the sealing liquid 60 be 5 μm to 50 μm in order to avoid affecting ink discharge properties and to ensure efficient ink discharge.

Since the nozzles 51 are covered with the sealing liquid 60, there is a possibility that the sealing liquid 60 may adhere to the record paper together with the ink when the ink is discharged. Hence, the sealing liquid 60 is made transparent or given a color similar in tone to the ink.

In order to make the sealing liquid 60 be transparent, the transmittance of the sealing liquid 60 in the visible light spectrum may be increased by reducing the size of the ultraviolet light-shielding particles to approximately between several tens nanometers to 10 nm. Furthermore, the sealing liquid 60 may be given a color similar to that of the ink by dispersing or dissolving a coloring agent in liquid, the coloring agent has a similar or same color hue to the ink.

Figure 5:
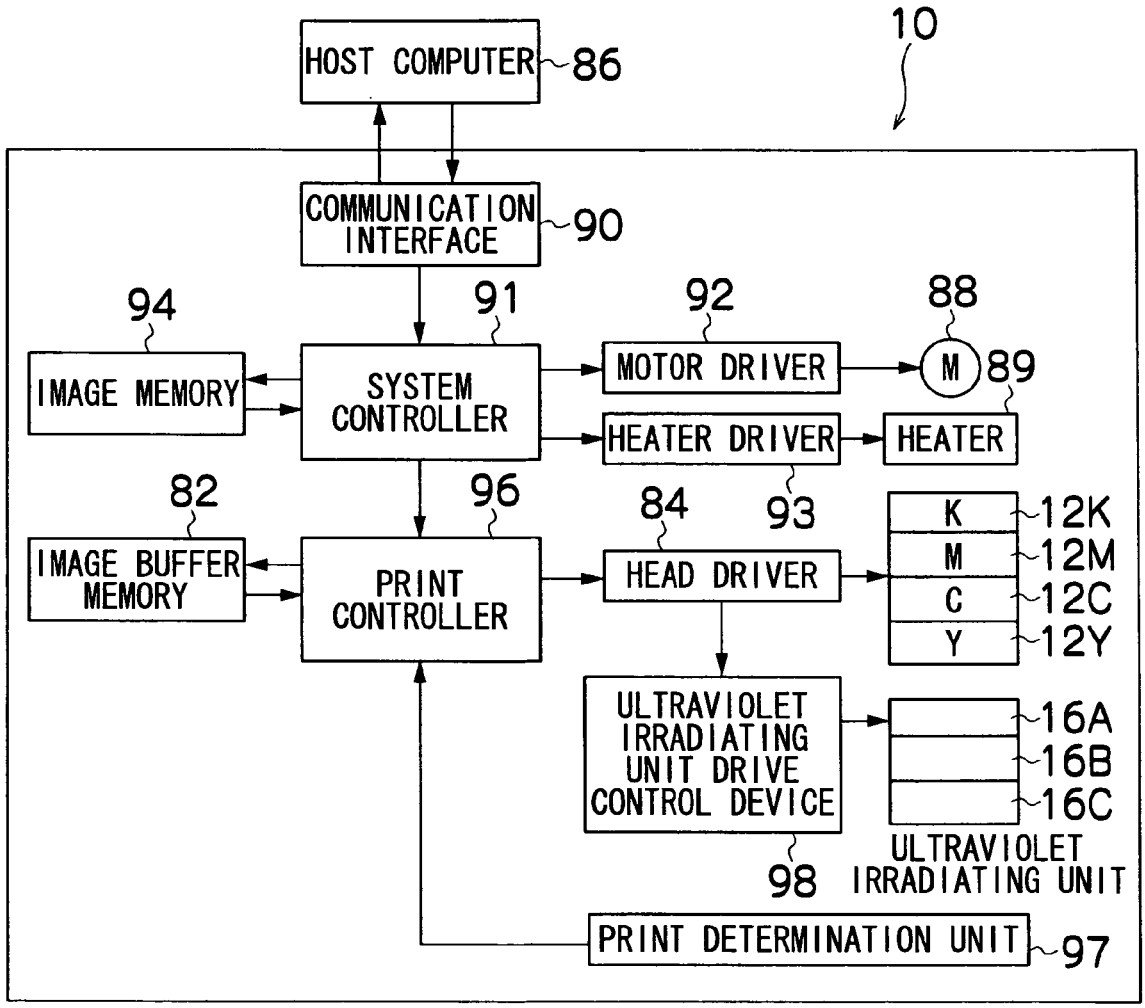
FIG. 5 is a principal block diagram showing a system composition of the inkjet recording apparatus.

Next, the control system of the inkjet recording apparatus 10 is described. FIG. 5 is a principal block diagram showing the system composition of the inkjet recording apparatus 10. The inkjet recording apparatus 10 comprises a communication interface 90, a system controller 91, an image memory 94, a motor driver 92, a heater driver 93, a print controller 96, an image buffer memory 82, a head driver 84, an ultraviolet irradiating unit drive control device 98, ultraviolet irradiating units 16A, 16B and 16C, and the like.

The communication interface 90 is an interface unit for receiving image data transmitted by a host computer 86. For the communication interface 90, a serial interface such as the USB, the IEEE 1394, the Ethernet, and a wireless network, and a parallel interface such as Centronics, can be used. It is also possible to install a buffer memory (not shown) in the communication interface 90 for achieving high-speed communication. Image data sent from a host computer 86 is imported into the inkjet recording apparatus 10 via the communication interface 90, and it is stored in the image memory 94. The image memory 94 is a storage device for storing an image input through the communication interface 90, and data is written to and read from the image memory 94 through the system controller 91. The image memory 94 is not limited to a memory made from a semiconductor element, and a magnetic medium, such as a hard disk, and others may be used as the image memory 94.

The system controller 91 is a control unit for controlling the various sections, such as the communication interface 90, the image memory 94, the motor driver 92, the heater driver 93, and others. The system controller 91 comprises a central processing unit (CPU) and peripheral circuits thereof, and controls the communication with the host computer 86, controls the reading from and writing to the image memory 94, and generates control signals for controlling the motor 88 of the conveyance system and the heater 89.

The motor driver 92 is a driver (drive circuit) which drives the motor 88 in accordance with the instructions from the system controller 91. The heater driver 93 is a driver that drives the heater 89 in accordance with the instructions from the system controller 91.

According to the control implemented by the system controller 91, the print controller 96 is a control unit that has a signal processing function for performing various treatment processes, corrections, and the like, in order to generate a signal for controlling printing according to the image data in the image memory 94, and furthermore, sends the generated print control signal (image data) to the head driver 84. Prescribed signal processing is carried out in the print controller 96, and the discharge amount and the discharge timing of the ink droplets from the print head 50 are controlled through the head driver 84 according to the image data. By this means, the desired dot size and dot positions can be achieved.

The print controller 96 is connected to the image buffer memory 82. The data, such as image data, parameters data, and other data, are temporarily stored in the image buffer memory 82 when the image data is processed in the print controller 96. FIG. 5 shows an example in which the image buffer memory 82 is attached to the print controller 96, however, the image memory 94 may also serve as the image buffer memory 82. Moreover, an example is also possible in which the print controller 96 and the system controller 91 are integrated and constituted by a single processor.

According to the print data supplied by the print controller 96, the head driver 84 is a driver that drives the actuators of the print heads 12K, 12M, 12C and 12Y of the respective colors, and drives the ultraviolet irradiating unit drive control device 98. The head driver 84 may include a feedback control system for maintaining constant drive-conditions for the print heads.

The ultraviolet irradiating unit drive control device 98 comprises a light source control circuit, which controls the on/off operation, the lighting position, and the emission luminous energy during the emission concerning the light sources of the ultraviolet irradiating units 16A, 16B and 16C. The ultraviolet irradiating unit drive control device 98 controls the emission from the ultraviolet irradiating units (16A, 16B, 16C) according to the instructions from the head driver 84.

The print determination unit 97 is a block including a line sensor, obtains the image printed onto the record paper 20, performs various required signal processing operations and the like, determines the print situation (e.g., whether the discharge is performed or not, variation in droplet discharge, etc.), and supplies these determination results to the print controller 96.

According to requirements, the print controller 96 makes various corrections with respect to the print head 50 on the basis of the information obtained from the print determination unit 97.

FIGS. 6A and 6B show the relationship among the ink 59 (ultraviolet-curable ink) discharged from a nozzle 51, the sealing liquid 60, and the irradiation position by the ultraviolet irradiating unit 16. More specifically, FIG. 6A shows a case during ink discharge, and FIG. 6B shows a case during irradiation of ultraviolet light.

The ultraviolet irradiating unit 16 is disposed in such a manner that it irradiates ultraviolet light onto an ink droplet 59*a* discharged from the nozzle 51, immediately before the ink droplet 59*a* adheres to the print surface of the record paper 20. In the present embodiment, as shown in FIG. 6B, in order that ultraviolet light is irradiated only onto the ink droplet 59*a* in flight, the ultraviolet irradiating unit 16 is disposed in such a manner that the irradiation light travels in a substantially orthogonal direction to the direction of the flight of the ink droplet 59*a*. The ultraviolet irradiating unit 16 may irradiate the ultraviolet light onto the droplet before it adheres to the print surface of the record paper 20, and therefore the ultraviolet irradiating unit 16 may be positioned in the vicinity of the nozzle 51. The ultraviolet irradiating unit 16 may be disposed to the side of the conveyance direction of the record paper 20 and to the side of the orthogonal direction to the conveyance direction, with respect to the nozzle 51.

In the composition described above, as shown in FIG. 6A, ultraviolet-curable ink 59 is discharged from the nozzle 51 through the sealing liquid 60. Although the seal is broken when the ink 59 is discharged, the sealing liquid 60 seeps out from the porous member 62 and hence the nozzle 51 is immediately sealed by the sealing liquid 60 as shown in FIG. 6B. The ink droplets 59*a* that have been discharged are irradiated with ultraviolet light by the ultraviolet irradiating unit 16 before they adhere to the print surface of the record paper 20, and then the ink droplets sequentially harden after adhering to the print surface of the record paper 20. In this way, after the ultraviolet-curable ink 59 is discharged, the nozzle 51 is immediately sealed by the sealing liquid 60 supplied through the porous member 62 communicating with the sealing liquid supply passage 66. Hence, the scattered light generated by the irradiation of ultraviolet light onto the ink droplet 59*a* does not reach the ultraviolet-curable ink 59 inside the nozzle 51.

Therefore, the ultraviolet-curable ink 59 inside the nozzle 51 does not harden due to the scattered light generated by the ultraviolet irradiation and hence the blocking of the nozzle 51 is prevented. Furthermore, since the ink of low viscosity is generally used in the print head 50 from the viewpoint of good ink discharge characteristics, bleeding of the ink and/or broadening of the dots are liable to occur. However, in the present embodiment, since ultraviolet light is irradiated onto the ink immediately after it has been discharged, the ink bleeding and the like are prevented, even if the ultraviolet-curable ink of low viscosity is used. Therefore, a printed object can be obtained which does not suffer deterioration in image quality, even if the printed surface is touched immediately after printing.

In the inkjet recording apparatus 10 according to the present embodiment, a sealing liquid 60 which absorbs or reflects radiation in a particular wavelength range (e.g., in the present embodiment, ultraviolet light) is provided at the nozzles 51, and hence the meniscus surface of the ink 59 can be shielded completely. Therefore, it is possible to prevent the blocking of nozzles due to the scattered light and others generated by the irradiation of ultraviolet light onto the ultraviolet-curable ink by means of the ultraviolet irradiating units 16.

Since there are few possibilities of nozzle blockages due to the scattering of irradiated light, it is possible to position the irradiation light source very close to the nozzles, and hence a strong intensity of ultraviolet light can be irradiated in the vicinity of the nozzles 51, onto the ink droplets 59*a* in flight which have been discharged from the nozzles 51.

Furthermore, in the present embodiment, the sealing liquid 60 is supplied from the flow path formed by the porous member 62, and consequently, it is not necessary to fabricate complicated flow paths, and the inkjet recording apparatus 10 can be manufactured easily and inexpensively.

Second Embodiment

Figure 7A:
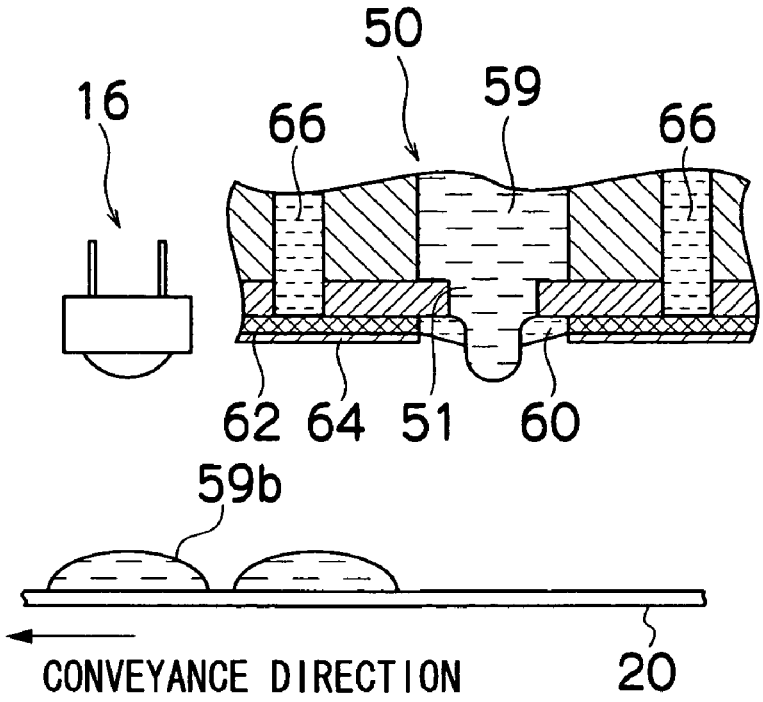
FIGS. 7A and 7B are diagrams showing the relationship between the nozzle and the ultraviolet irradiating unit according to a second embodiment.
Figure 7B:
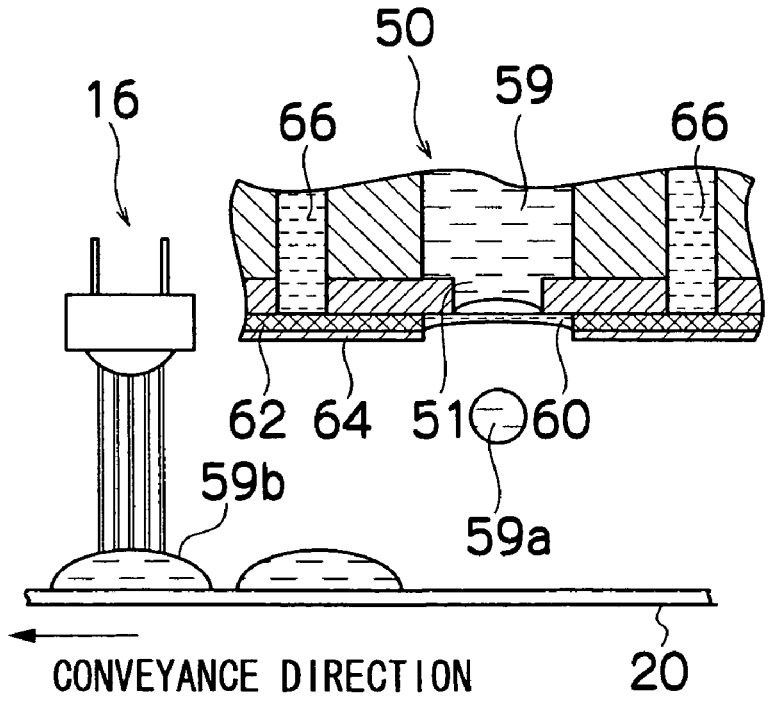

FIGS. 7A and 7B show the relationship among the ink discharged from a nozzle 51, the sealing liquid 60, and the irradiation position by the ultraviolet irradiating unit 16 in a second embodiment of the present invention. More specifically, FIG. 7A shows a case during ink discharge, and FIG. 7B shows a case during irradiation of ultraviolet light. As shown in FIGS. 7A and 7B, this second embodiment differs from the first embodiment described above in that the ultraviolet irradiating unit 16 irradiates ultraviolet light to the ink after the ink has adhered to the print surface of the record paper 20. The other compositions are the substantially same as those of the first embodiment.

As shown in FIG. 7A, the ultraviolet irradiating unit 16 is disposed at the position adjacent to the print head 50 in such a manner that the ultraviolet irradiating unit 16 irradiates ultraviolet light onto the record paper 20 in line with the print head 50. As shown in FIG. 7B, when an ink droplet 59*b* that has been discharged onto the record paper 20 is conveyed directly below the ultraviolet irradiating unit 16 owing to the conveyance of the record paper 20, the ultraviolet light is irradiated onto the ink droplet 59*b* by the ultraviolet irradiating unit 16. In this case, as shown in FIG. 7B, the irradiation light is irradiated onto the ink droplet in a substantially parallel direction to the flight direction of the ink droplets 59*a*.

In the present embodiment, as shown in FIG. 7A, though the seal is broken when ink is discharged, since the sealing liquid 60 immediately seeps out from the porous member 62 and the nozzle 51 becomes sealed by the sealing liquid 60; the ink 59 inside the nozzles 51 is not caused to harden due to the scattered light generated from the light irradiated onto the ink droplet 59*b* on the record paper 20, and hence the blocking of the nozzles 51 is prevented.

In this way, in the second embodiment, similar operations and beneficial effects to those of the first embodiment, and the following beneficial effect that is specific to the second embodiment can be obtained. Namely, since the irradiation time of the radiation, such as ultraviolet light, can be set to be a longer time than in the first embodiment, it is possible to reduce the intensity of the radiation, and hence scattering of the light to the nozzles can be suppressed.

Third Embodiment

Figure 8A:
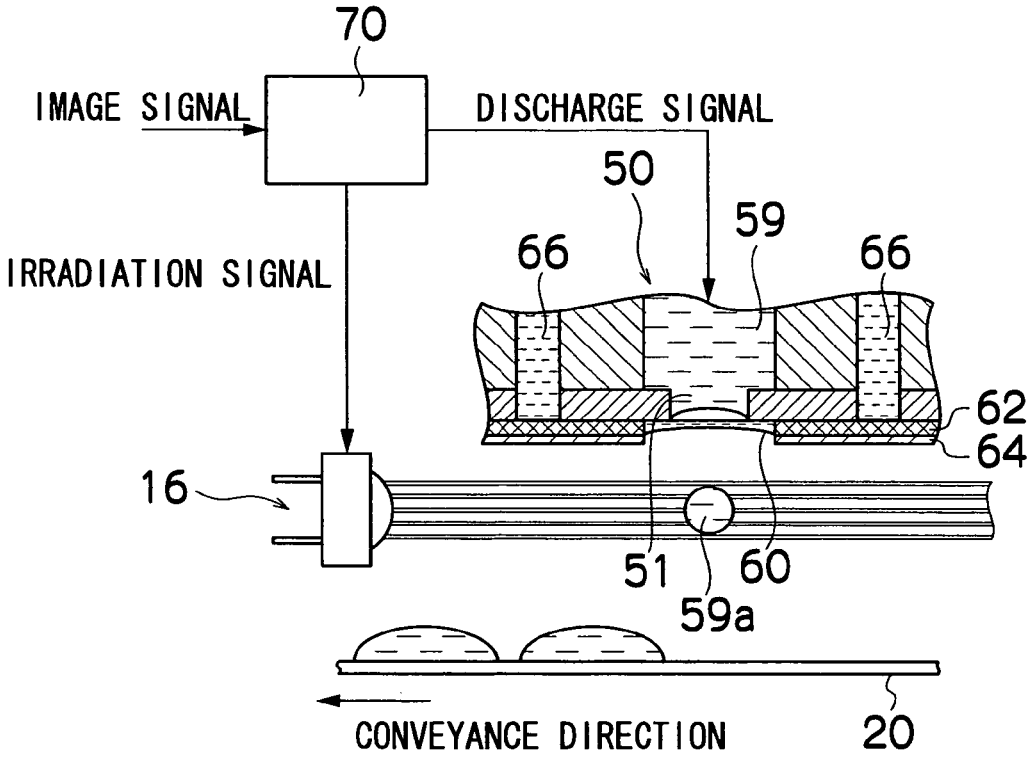
FIGS. 8A and 8B are diagrams showing the relationship between the nozzle and the ultraviolet irradiating unit according to a third embodiment.
Figure 8B:
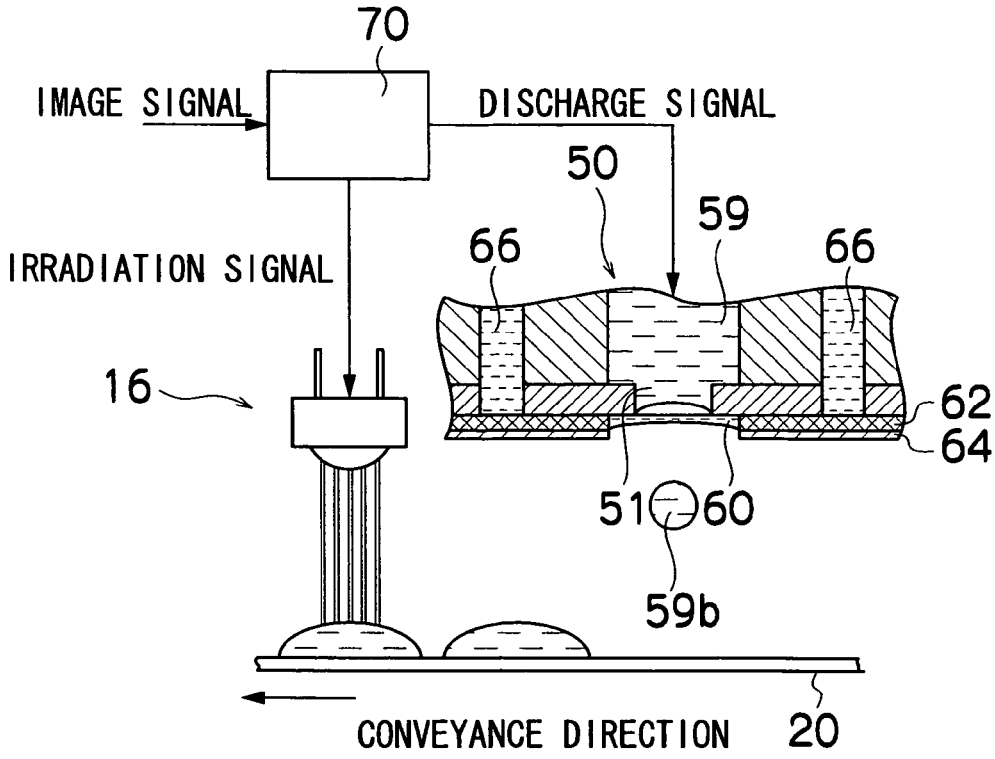

FIGS. 8A and 8B show the relationship among the ink discharged from the nozzle 51, the sealing liquid 60, and the irradiation position by the ultraviolet irradiating unit 16 in a third embodiment of the present invention. More specifically, FIG. 8A shows a case where ultraviolet light is irradiated onto an ink droplet in flight, and FIG. 8B shows a case where ultraviolet light is irradiated onto an ink droplet on the record paper.

As shown in FIGS. 8A and 8B, in this third embodiment, the inkjet recording apparatus 10 comprises a signal control device 70 that controls the irradiation of ultraviolet light onto the ink droplets by the ultraviolet irradiating units 16, in such a manner that the irradiation is performed in synchronism with the discharge of the ink from the nozzles 51. FIG. 8A corresponds to the first embodiment described above and shows a case where ultraviolet light is irradiated onto the ink droplets in flight, and FIG. 8B corresponds to the second embodiment and shows a case where ultraviolet light is irradiated onto the ink droplets on the record paper 20. In FIGS. 8A and 8B, parts which are the substantially same as those in FIGS. 6A and 6B showing the first embodiment and those in FIGS. 7A and 7B showing the second embodiment are labeled with the same reference numerals, and further descriptions thereof are omitted here. The signal control device 70 sends an ink discharge signal to the print head 50 in accordance with an image signal and the like. Upon receiving the ink discharge signal, the print head 50 causes ink to be discharged from the nozzles 51 by operating the actuators and others.

Furthermore, the signal control device 70 also outputs an irradiation signal to the ultraviolet irradiating unit 16, the irradiation signal being delayed by a prescribed delay time t from the ink discharge signal that is sent according to the image signal or the like. This delay time t is set to be an optimum time period by taking account of at least one of the design factors, such as the film thickness, the kinematic viscosity, and the surface tension of the sealing liquid 60, the position onto which light is irradiated by the ultraviolet irradiating units 16 (the positional relationship between the nozzle 51 and the ultraviolet irradiating unit 16), and others. In the case of FIG. 8A, the delay time t is set, in such a manner that the ultraviolet irradiating unit 16 performs irradiation of ultraviolet light onto the ink droplet 59*a* before the ink droplet 59*a* discharged from the nozzle 51 has adhered to the record paper 20, and while the nozzle 51 is sealed by the sealing liquid 60. On the other hand, in the case of FIG. 8B, the delay time t is set, in such a manner that the ultraviolet irradiating unit 16 performs irradiation of ultraviolet light onto the ink droplet 59*b* when the ink droplet 59*b* that has been discharged from the nozzle 51 and has adhered to the record paper 20 is conveyed directly under the ultraviolet irradiating unit 16 owing to the conveyance of the record paper 20, and while the nozzle 51 is sealed by the sealing liquid 60.

The signal control device 70 may be disposed in the print head 50, may be disposed in a part of the inkjet recording apparatus 10 other than the print head 50, and may be disposed in conjunction with an electrical circuit or others for controlling the print head 50 and/or the inkjet recording apparatus 10.

In this third embodiment, similar operations and beneficial effects to those of the first and second embodiments, and the following beneficial effects that are specific to the third embodiment can be obtained. More specifically, according to the present embodiment, the blocking of the nozzles is prevented, since the irradiation of ultraviolet light by the ultraviolet irradiating units 16 is performed in synchronization with the discharge of the ink from the nozzles 51 by means of the signal control device 70, and the ultraviolet light is not irradiated by the ultraviolet irradiating units 16 when the light shield is broken during discharge of ink. Furthermore, since the ultraviolet irradiating units 16 are able to emit the pulsed light, the ultraviolet light with a stronger intensity, compared to the normal light emission, can be irradiated momentarily, and hence the hardening reaction of the ultraviolet-curable ink can be performed efficiently.

Although the first to third embodiments described above are explained with respect to cases using ultraviolet-curable ink, the present invention is not limited to the cases using ultraviolet-curable ink. The present invention can be also applied to the inks that can be set by the irradiation of another type of radiation, such as electron beams, X rays, or others. In these cases, radiation irradiating units suitable for activating the hardening agent (for activating the polymerization) are provided in accordance with the ink that is used.

Fourth Embodiment

Figure 9:
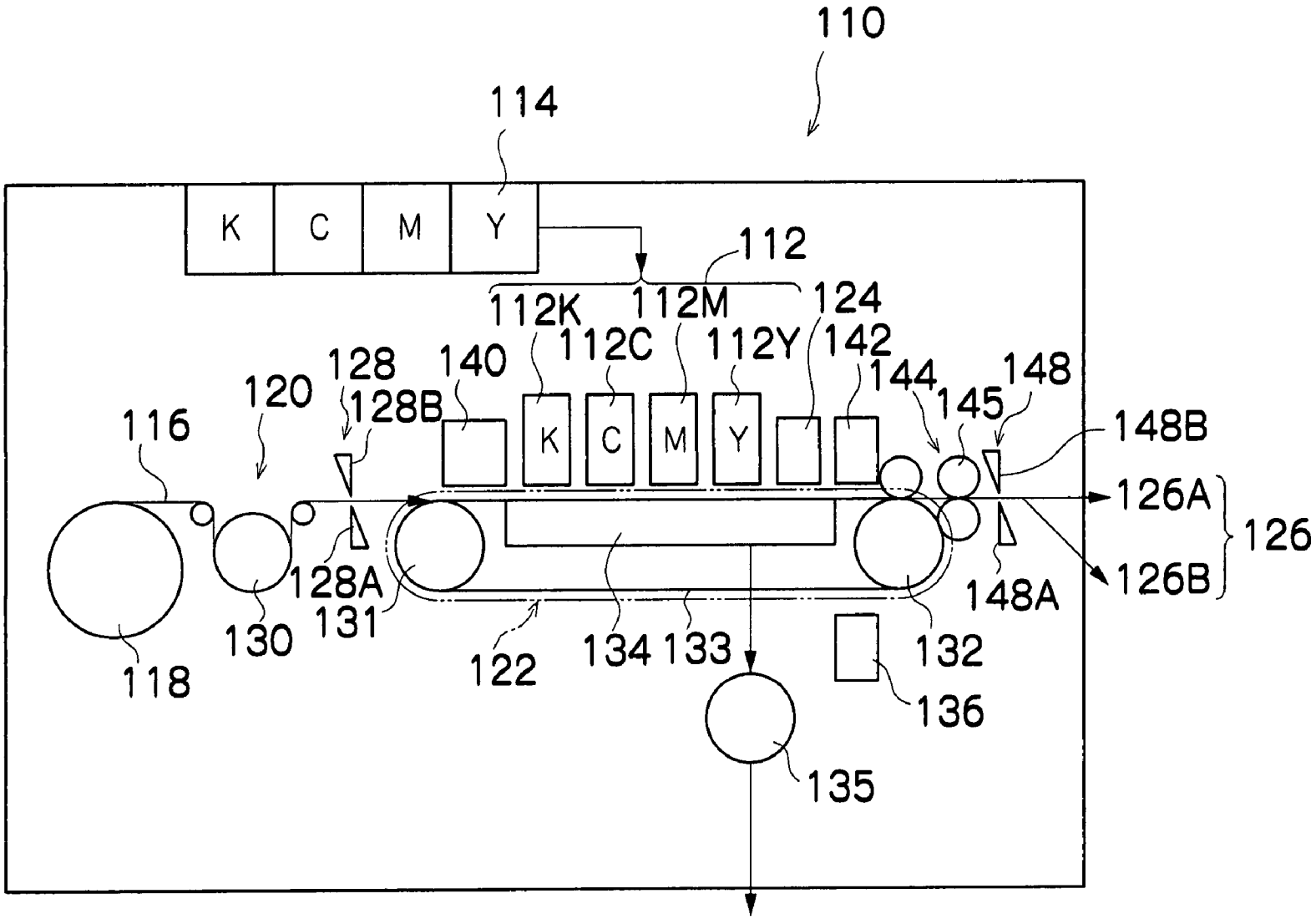
FIG. 9 is a general compositional view of the inkjet recording apparatus relating to a fourth embodiment of the present invention.

FIG. 9 is a general compositional diagram of an inkjet recording apparatus according to a fourth embodiment of the present invention. As shown in FIG. 9, this inkjet recording apparatus 110 comprises a print unit 112 having a plurality of print heads 112K, 112C, 112M, 112Y provided corresponding to respective ink colors; an ink storing and loading unit 114 for storing ink to be supplied to the print heads 112K, 112C, 112M and 112Y; a paper supply unit 118 for supplying record paper 116; a decurling unit 120 for removing curl in the record paper 116; a suction belt conveyance unit 122, disposed facing the nozzle face (ink discharge face) of the print unit 112, for conveying the record paper 116 while keeping the record paper 116 flat; a print determination unit 124 for reading in the print results; and a paper output unit 126 for outputting the recorded record paper (printed matter) to the exterior.

In FIG. 9, a single magazine for rolled paper (continuous paper) is shown as an example of the paper supply unit 118, however, a plurality of magazines with paper differences, such as paper width and quality, may be placed side by side. Moreover, paper may be supplied by a cassette that contains cut papers loaded in layers and that is used in combination with or in lieu of a magazine for a rolled paper.

In the case of a configuration in which roll paper is used, a cutter 128 is provided as shown in FIG. 9, and the roll paper is cut to be a desired size by the cutter 128. The cutter 128 has a stationary blade 128A having a length no less than the width of the conveyance path of the record paper 116, and a round blade 128B that moves along the stationary blade 128A. The stationary blade 128A is disposed on the reverse side of the printed surface of the record paper 116, and the round blade 128B is disposed on the printed surface side across the conveyance path from the stationary blade 128A. When cut paper is used, the cutter 128 is not required.

In the case of a configuration in which a plurality of types of record paper can be used, it is preferable that an information recording medium, such as a bar code and a wireless tag, containing information about the type of paper is attached to the magazine, and by reading the information contained in the information recording medium with a predetermined reading device, the type of paper to be used is automatically determined, and ink droplet discharge is controlled so that the ink-droplets are discharged in an appropriate manner in accordance with the type of paper.

The record paper 116 delivered from the paper supply unit 118 retains curl due to having been loaded in the magazine. In order to remove the curl, in the decurling unit 120, heat is applied to the record paper 116 by a heating drum 130 in the direction opposite to the curl direction in the magazine. In this case, the heating temperature is preferably controlled so that the surface on which the print is to be made is slightly rounded in the outward direction.

The decurled and cut record paper 116 is delivered to the suction belt conveyance unit 122. The suction belt conveyance unit 122 has a configuration in which an endless belt 133 is set around rollers 131 and 132 in such a manner that at least the portion of the endless belt 133 facing the nozzle faces of print heads 112K, 112C, 112M, and 112Y of the print unit 112 and the sensor face of the print determination unit 124 form a horizontal plane (flat plane).

The belt 133 has a width that is greater than the width of the record paper 116, and a plurality of suction apertures (not shown) are formed on the belt surface. As shown in FIG. 9, a suction chamber 134 is disposed in a position facing the sensor surface of the print determination unit 124 and the nozzle surface of the print unit 112 on the inner side of the belt 133 set around the rollers 131 and 132. The record paper 116 is suctioned and held on the belt 133 by creating a negative pressure by means of sucking the suction chamber 134 by a fan 135.

The drive force of a motor (not shown) is transmitted to at least one of the rollers 131 and 132 around which the belt 133 wound, thereby the belt 133 is driven in clockwise direction in FIG. 9. Accordingly, the record paper 116 suctioned onto the belt 133 is conveyed from left to right in FIG. 9.

The belt 133 is driven in the clockwise direction in FIG. 9 by the power of a motor (not shown) being transmitted to at least one of the rollers 131 and 132 around which the belt 133, and the record paper 116 held on the belt 133 is conveyed from left to right in FIG. 9 accordingly.

Since ink adheres to the belt 133 when a marginless print job or the like is performed, a belt-cleaning unit 136 is disposed in a predetermined position (a suitable position outside the printing area) on the outer side of the belt 133. Although the details of the configuration of the belt-cleaning unit 136 are not depicted, examples thereof include a configuration in which the belt 133 is nipped with a cleaning roller such as a brush roller and a water absorbent roller, an air blow configuration in which clean air is blown onto the belt 133, and a combination of these. In the case of a configuration in which the belt 133 is nipped with a cleaning roller, a greater cleaning effect is obtained if the linear velocity of the cleaning roller is adjusted to be different from that of the belt 133.

The inkjet recording apparatus 110 may comprise a roller nip conveyance mechanism, instead of the suction belt conveyance unit 122. However, in this case, there is a possibility that, if the printing area is conveyed by a roller nip, the print is liable to become smeared because the roller makes contact with the printed surface of the paper immediately after printing. Hence, the suction belt conveyance in which no element makes contact with the image surface in the printing area is preferable.

A heating fan 140 is disposed on the upstream side of the print unit 112 in the sheet conveyance path formed by the suction belt conveyance unit 122. The heating fan 140 blows heated air onto the record paper 116 to heat the record paper 116. By heating the record paper 116 immediately before printing, the ink dries more readily after being deposited onto the record paper 116.

The print unit 112 forms a so-called full-line head in which a line head having a length corresponding to the maximum paper width is disposed in a direction (i.e., the main-scanning direction) which is orthogonal to the conveyance direction of the record paper 116 (i.e., the sub-scanning direction). Each of the print heads 112K, 112C, 112M, and 112Y adopts a line head, in which a plurality of nozzles (not shown in FIG. 9) are arranged on the nozzle face along a length exceeding at least one side of the maximum-size record paper 116 intended for use in the inkjet recording apparatus 110.

The print heads 112K, 112C, 112M and 112Y corresponding to the respective color inks of black (K), cyan (C), magenta (M) and yellow (Y) are arranged in this order from the upstream side in the sub-scanning direction. A color image can be formed on the record paper 116 by discharging the color inks from the print heads 112K, 112C, 112M, and 112Y, respectively, onto the record paper 116 while the record paper 116 is conveyed.

Using this print unit 112, in which full-line heads covering the entire width of the paper are provided for each of the ink colors, it is possible to record an image on the full surface of the record paper 116 by means of performing just one operation of relatively moving the record paper 116 with respect to the print unit 112 in the sub-scanning direction, (in other words, by means of one scanning action). Hence, higher-speed printing is possible and productivity can be improved in comparison with a shuttle type head configuration in which a print head moves back and forth reciprocally in the main scanning direction.

Although a configuration with the four standard colors KCMY is illustrated by an example in the present embodiment, the combinations of the ink colors and the number of colors are not limited to these. Light and/or dark inks, and special color inks can be added as required. For example, a configuration is possible in which print heads for discharging light-colored inks such as light cyan and light magenta are added.

As shown in FIG. 9, the ink storing and loading unit 114 has tanks for storing the inks of the colors corresponding to the print heads 112K, 112C, 112M, and 112Y, and the tanks communicate with the print heads 112K, 112C, 112M, and 112Y through respective channels (not shown). The ink storing and loading unit 114 has a warning device (for example, a display device or an alarm sound generator) for warning when the remaining amount of any ink is low, and has a mechanism for preventing loading errors among the colors.

The print determination unit 124 includes an image sensor (e.g., line sensor) for capturing an image of the ink droplet deposition results brought by the print unit 112, and functions as a device which checks for discharge defects, such as nozzle blockages and others according to the ink droplet deposition results determined by the image sensor.

The print determination unit 124 according to the present embodiment adopts a line sensor comprising a row of photoreceptor elements of a width that is at least greater than the width of the ink droplet discharge (the width of the image recording) of the print heads 112K, 112C, 112M and 112Y. This line sensor has a color-separation-line-CCD-sensor including a red (R) sensor row composed of the photoelectric transducer elements (pixels) that are provided with a red filter respectively and arranged in a line, a green (G) sensor row provided with a green filter, and a blue (B) sensor row provided with a blue filter. Instead of the line sensor, it is also possible to use an area sensor composed of the photoelectric transducer elements that are arranged in a two-dimensional configuration.

The print determination unit 124 determines a test pattern printed by the print heads 112K, 112C, 112M and 112Y corresponding to the respective colors, and determines the discharge conditions of each of the heads. This discharge determination includes identification of whether each of the heads discharges ink or not, measurement of the dot size, and measurement of the dot landing position.

A post-drying unit 142 is disposed after the print determination unit 124. The post-drying unit 142 is a device for drying the printed image surface, and includes a heating fan as an example. It is preferable to avoid the contact between the printed surface and others until the printed ink dries, and hence the system that blows heated air onto the printed surface is desirable.

In cases where printing is performed using a combination of dye-based ink and a porous paper, if the pores in the paper are blocked by applying pressure so that the ink is prevented to contact with ozone and other substances that cause the dye molecules to break down, then there is an effect that the weather resistance of the printed image is improved.

A heating/pressurizing unit 144 is disposed after the post-drying unit 142, and is a device for controlling the glossiness of the image surface. The heating/pressurizing unit 144 presses the image surface with a pressure roller 145 having a predetermined uneven surface shape as heating the image surface, thereby the image surface is transformed to the uneven shape.

The printed matter made in this manner is output from the paper output unit 126. Desirably, the target image to be printed (namely, the result of printing an objective image) and the test print are separately output. In the inkjet recording apparatus 110, a sorting device (not shown) is provided for switching the output channel in order to sort the printed matter with the target image from the printed matter with a test print and to separately send the printed matters to the corresponding unit of the paper output units 126A and 126B. When the target print and the test print are simultaneously formed in parallel on the same large sheet of paper, then the test print portion is cut off by a cutter (second cutter) 148. The cutter 148 is disposed immediately before the paper output unit 126, and serves to cut the portion of the test print from the portion of the target print when a test print has been made in the blank portion in which the image is unprinted. The structure of the cutter 148 is the substantially same as that of the first cutter 128 described above, and comprises a stationary blade 148A and a round blade 148B.

In spite of not shown in FIG. 9, the paper output unit 126A corresponding to the target prints is provided with a sorter for collecting images according to print orders.

Figure 10:
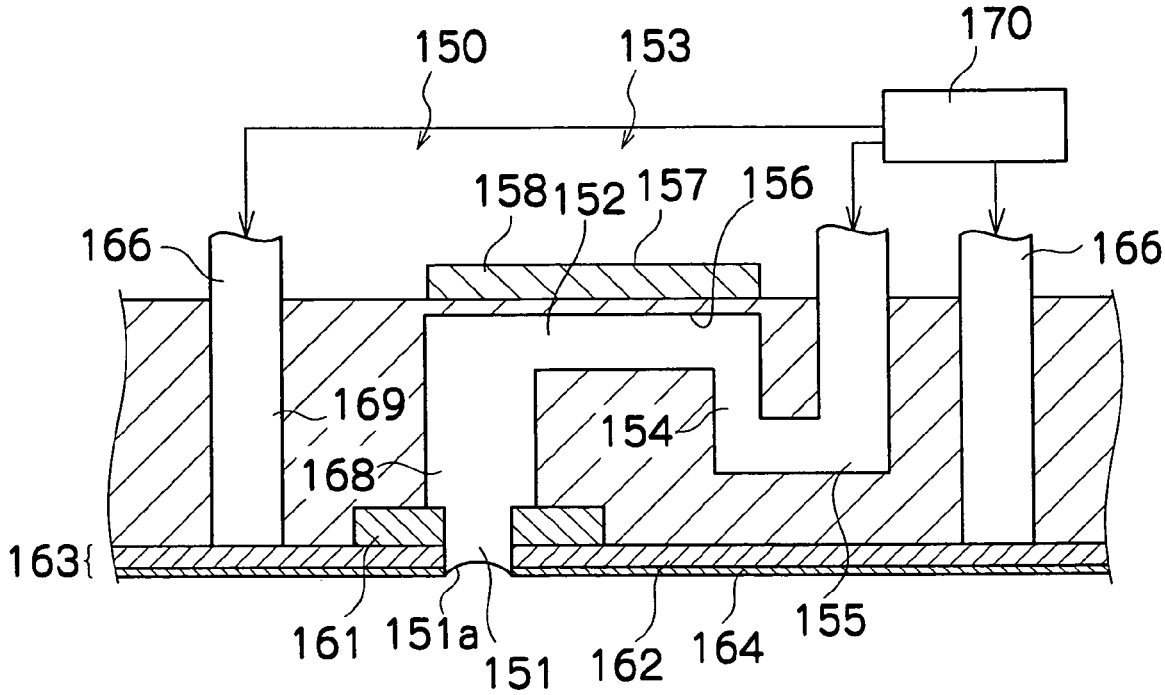
FIG. 10 is a cross-sectional diagram showing the composition of an ink chamber unit of the print head.

Next, the structure of the inkjet recording head (print head) will be described. The print heads 112K, 112C, 112M, and 112Y provided for each of the ink colors have the common structure, and a reference numeral 150 hereinafter stands for any of the print heads 112K, 112C, 112M and 112Y. The planar structure of the print head 150 is similar to that of the first embodiment (see FIG. 3), and hence description thereof is omitted here. FIG. 10 is a cross-sectional diagram showing the three-dimensional composition of an ink chamber unit (pressure chamber unit) 153 of the print head 50, and it corresponds to the cross-sectional diagram of the ink chamber unit 53 shown in FIG. 3. As shown in FIG. 10, the print head 150 comprises: a pressure chamber 152 provided corresponding to a pressure chamber unit 153; a supply port 154 communicating with the pressure chamber 152; a common flow path (firs ink supply path) 155 communicating with the supply port 154; a partition 161 formed with an discharge flow path; a porous member 162 provided on the ink discharge side of the partition 161; a coating layer 164 covering the ink discharge side of the porous member 162; and a second ink supply path 166 communicating with the porous member 162. The porous member 162 and the coating layer 164 are referred to as the orifice plate 163.

The pressure chamber 152 communicates with the nozzle 151 and the supply port 154, and furthermore, each pressure chamber 152 communicates with the common flow path (first ink supply path) 155 via the supply port 154.

An actuator 158 provided with an individual electrode 157 is joined to a pressure plate 156 (common electrode) which forms the upper face of the pressure chamber 152. When a drive voltage is applied to the individual electrode 157 and the common electrode 156, the actuator 158 is deformed, thereby the ink 168 is discharged from the nozzle 151. When ink 168 has been discharged, new ink 168 is supplied to the pressure chamber 152 from the common flow path (first ink supply path 155), via the supply port 154. The other end of the common flow path (first ink supply path) 155 communicates with an ink supply tank (not shown in FIG. 10) which stores ink 168.

The orifice plate 163 has openings for the nozzles 151, and a porous member 162 that can be impregnated with ink is provided with this orifice plate 163. A second ink supply path 166 communicates with the porous member 162, and this second ink supply path 166 communicates with a sub-tank (not shown in FIG. 10) that stores ink.

The second ink supply path 166 supplies ink 169 from the sub-tank to the porous member 162. The ink 169 supplied to the porous member 162 is supplied to the meniscus surface 151*a*. Hereinafter, the system for supplying ink from the second ink supply path 166 via the porous member 162 to the meniscus surface 151*a* is referred to as the second ink supply system, and the system for supplying ink from the first ink supply path 155 via the pressure chamber 152 to the nozzle 151 is referred to as the first ink supply system. The ink 169 supplied from the second ink supply system to the meniscus surface 151*a* prevents the ink at the meniscus surface 151*a* from increasing in viscosity.

The porous member 162 is a member with a porous characteristic that can be impregnated with ink, and desirably, may have pores of diameter 10 μm or less. In the case of the print head having a plurality of nozzles 151, a complicated flow path is fundamentally required in order to supply the second ink 169 to each meniscus surface 151*a*. However, if the porous member 162 is used, then it is not necessary to form a new and complicated flow path and the like, and hence and the second ink supply system can be achieved readily. Moreover, since a uniform flow path can be formed by the porous member 162, it is possible to achieve a uniform supply of ink 169 to the meniscus surface 151*a* from the second ink supply system.

In order to prevent the ink 169 flowing in the porous member 162 from evaporating, a coating surface 164, such as a plated substance, is provided on the surface of the porous member 162 on the ink discharge side thereof.

The ink 169 supplied by the second ink supply system is the same as the ink 168 supplied by the first ink supply system. When the ink 168 supplied by the first ink supply system is discharged from the nozzle 151 toward the print medium, the ink 168 makes contact with the ink 169 supplied to the meniscus surface 151*a* from the second ink supply system. Hence, in the present embodiment, certain effects on the composition and properties of the ink 168, which can be occurred in the case of using a different liquid other than ink, are prevented.

As shown in FIG. 10, the print head 150 according to the present embodiment has a pressure control device 170 for controlling the pressure of the ink supplied by the first and second ink supply systems.

By controlling the pressure of the ink, the pressure control device 170 generates a low-speed flow of ink, whereby the ink supplied from the second ink supply system moves toward the ink discharge side and constantly supplies new ink to the meniscus surface 151*a* without the ink spilling out from the ink discharge port. By this means, increase in the viscosity of the ink at the meniscus surface 151*a* is prevented. The pressure control device 170 may be realizable by employing a device that regulates the height of the ink surface in the tank that stores the ink, or a pump. The embodiment example of the pressure control device 170 is described later.

Figure 11:
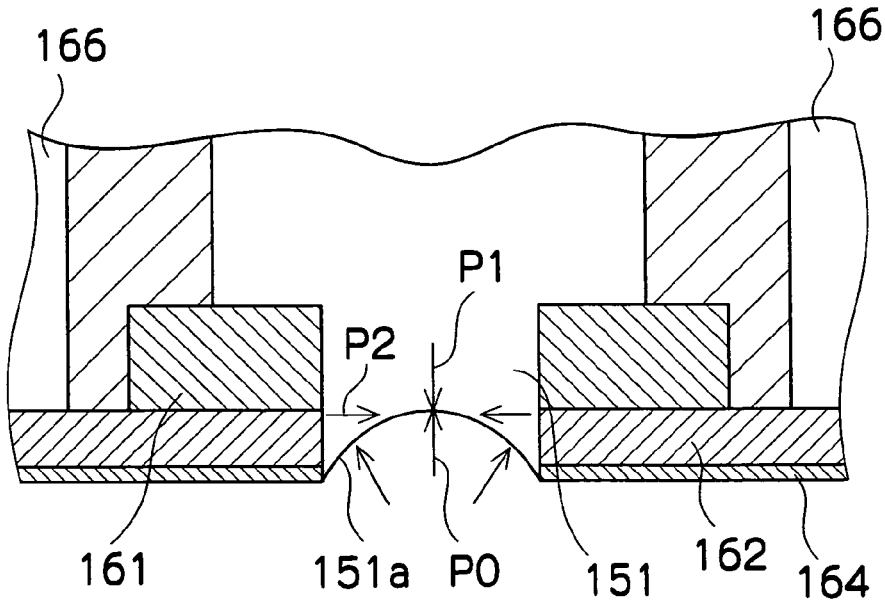
FIG. 11 is an enlarged view of the vicinity of the opening port of a nozzle.

FIG. 11 is an enlarged cross-sectional diagram of the region of the opening port of the nozzle 51. By supplying ink to the meniscus surface 151*a* from the second ink supply system, the meniscus surface 151*a* is caused to move toward the ink discharge side of the nozzle 151. In order to prevent the ink at the meniscus from spilling out from the opening port of the nozzle 151, as shown FIG. 11, the pressure control device 170 is required to stabilize the shape of the meniscus surface 151*a* in such a manner that the meniscus surface 151*a* forms a recessed shape toward the interior of the pressure chamber 152.

In order to generate a low-speed flow of the ink for preventing increase in the viscosity of the ink as the shape of the meniscus surface 151*a* is stabilized, the pressure control device 170 may perform control so as to satisfy the following expression (1):

$$P1<P2\leqq P0, \quad (1)$$

where the atmospheric pressure is designated as P0, the pressure of the ink 168 from the first ink supply system is designated as P1, and the pressure of the ink 169 from the second ink supply system is designated as P2.

In other words, the pressure control device 170 may perform the pressure control in such a manner that the pressure P2 of the ink 169 in the second ink supply system is greater than the pressure P1 of the ink 168 in the first ink supply system, and that the pressure P2 is equal to or less than the atmospheric pressure P0. Thereby, it is possible to generate a stable flow of the ink, while ensuring that the meniscus surface 151*a* has a recessed shaped toward the interior of the pressure chamber 152 and is prevented to move toward the ink discharge side of the nozzle 151.

As described above, by the pressure control performed by means of the pressure control device 170, it is possible to generate a flow of the ink in which new ink 169 is supplied constantly to the meniscus surface 151*a* from the second ink supply system, thereby the increase in ink viscosity at the meniscus surface 151*a* can be prevented.

Furthermore, in contrast to spontaneous supply methods for supplying a moisture retention liquid or the like to the meniscus surface 151*a* according to capillary action alone, the pressure control device 170 forcibly supplies ink by controlling the pressures of the ink 168 in the first ink supply system and the ink 169 in the second ink supply system. Hence, even if the fluidity of the ink have decreased, it is still possible to actively supply ink from the second ink supply system to the meniscus surface 151*a*. Accordingly, in the present embodiment, it is possible to constantly maintain an effect of preventing increase in viscosity of the ink at the meniscus surface 151*a*.

Figure 12:
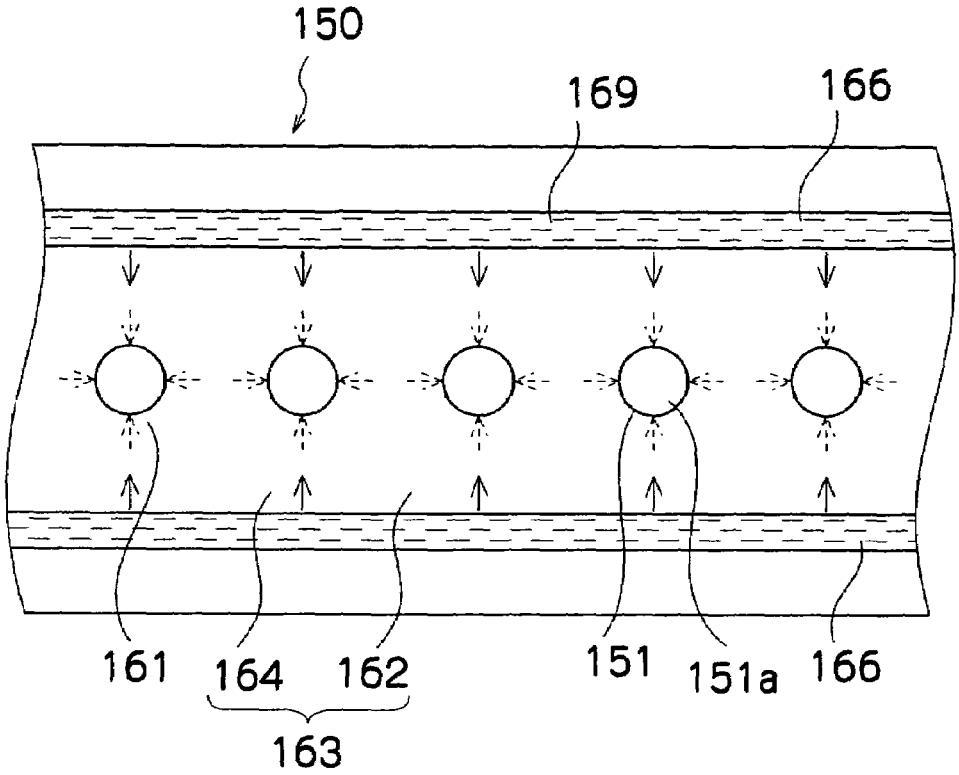
FIG. 12 is a plan view showing an example of the composition of a porous member in the print head.

FIG. 12 is a plan diagram showing an example of the composition of the porous member 162 in the print head 150. As shown in FIG. 12, second ink supply paths 166 are disposed above and below the arrangement of nozzles 151 in a direction parallel to the arrangement of nozzles 151. The whole region of the orifice plate 163 positioned between these upper and lower second ink supply paths 166 includes a porous member 162 and a coating layer 164. When the ink 169 is supplied to the second ink supply paths 166, the ink 169 is supplied simultaneously to the respective nozzles 151 via the porous member 162.

In FIG. 12, the solid arrows pointing toward the opening section of the nozzle 151 from the second ink supply paths 166 indicate the flow of the ink 169 supplied from the second ink supply paths 166 through the porous member 162. Furthermore, the dotted arrows pointing toward the center of the opening section of each nozzle 151 indicate the flow of the ink 169 that flows through the porous member 162 toward the meniscus surface 151*a* of each nozzle 151 at a uniform pressure.

As described above, the porous member 162 has porous properties, and hence there is high resistance in the porous member 162 to the ink 169 that is supplied by the second supply system and flows through the porous member 162, and the ink 169 is supplied to the meniscus surface 151*a* at a sufficiently slow speed of 0.01 mm/sec to 1 mm/sec. Hence, since there is an extremely small pressure differential between different positions, the ink is supplied to the meniscus surface 151*a* at a substantially uniform pressure as indicated by the dotted arrows in FIG. 12, and the shape of the meniscus surface 151*a* is kept stable.

Furthermore, as described above, since the flow of the ink 169 supplied by the second ink supply system to the meniscus surface 151*a* is sufficiently slow, the ink 169 does not obstruct the pressure wave generated when ink is discharged from the nozzles 151, and hence has no adverse effect on the ink discharge. Although the ink 169 supplied by the second ink supply system travels slowly, its speed is sufficient with respect to the speed of increase in the viscosity of the ink at the meniscus surface 151*a*. Hence, it is prevented that the ink at the meniscus surface 151*a* reaches a state of increased viscosity.

Figure 13:
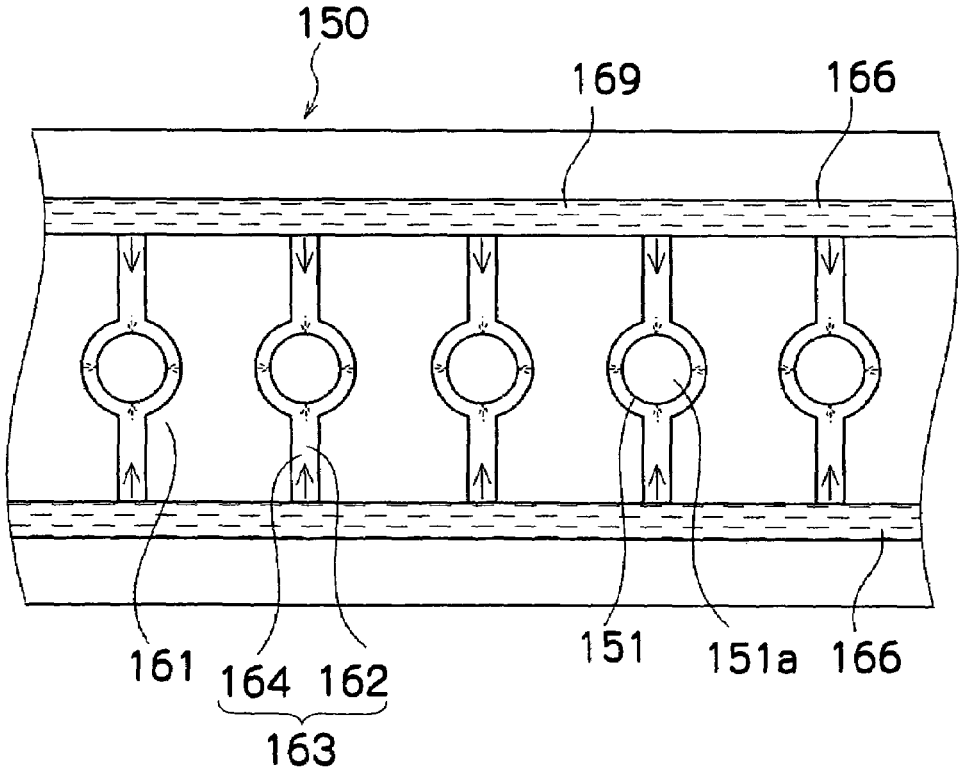
FIG. 13 is a plan view showing a further example of the composition of the porous member in the print head.

FIG. 13 is a plan diagram showing a further example of the composition of the porous member 162 in the print head 150. In FIG. 13, parts that are common to FIG. 12 are labeled with the same reference numerals. As shown in FIG. 13, the porous member 162 may be provided only in the portion communicating between the region of the opening port of each nozzle 151 and the second ink supply paths 166. By forming the porous members 162 in the limited regions in this way, it is possible to reduce the consumption of the ink 169 supplied by the second ink supply system.

Figure 14:
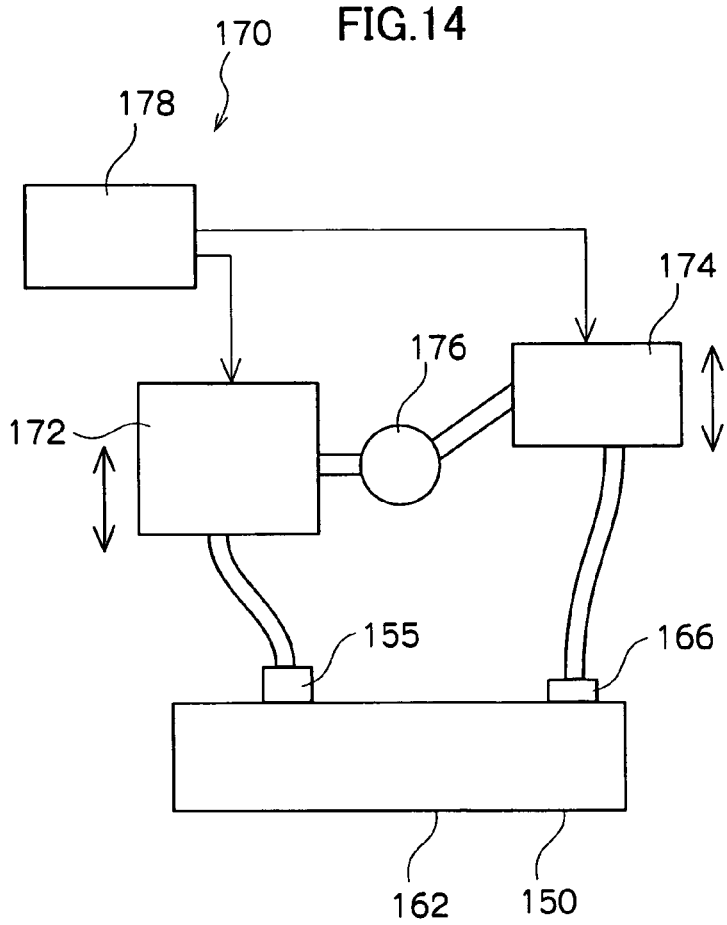
FIG. 14 is an illustrative diagram showing an example of the composition of a pressure control device.

FIG. 14 is an illustrative diagram showing an example of the composition of the pressure control device 170 relating to the present embodiment. The print head 150, including a plurality of the nozzles 151 (not shown in FIG. 14), communicates with the first ink supply path 155 and the second ink supply path 166 respectively.

The other end of the first ink supply path 155 communicates with the ink supply tank 172 storing the ink of the first ink supply system. Furthermore, the other end of the second ink supply path 166 communicates with the sub-tank 174 storing the ink of the second ink supply system.

A pump 176 is disposed in the supply path between the ink supply tank 172 and the sub-tank 174. By driving this pump, the ink stored in the ink supply tank 172 can be supplied to the sub-tank 174.

A pressure control device 170 includes a raising and lowering mechanism 178. The raising and lowering mechanism 178, as indicated by the arrows in FIG. 14, is able to move the ink supply tank 172 and the sub-tank 174 upwards and downwards respectively to change the heights. Thereby, the relative height of the ink supply tank 172 with respect to the nozzles 151 and the relative height of the sub-tank 174 with respect to the nozzles 151 are changeable. Consequently, it is possible to adjust the height of the tanks 172 and 174 in such a manner that the pressures at the meniscus become the pressures P1 and P2 that satisfy the expression (1) described above.

By adjusting the heights of the tanks 172 and 174 by means of the raising and lowering mechanism 178, it is possible to generate the flow of the ink, whereby the shape of the meniscus surface 151*a* is stabilized and new ink is constantly supplied to the meniscus surface 151*a* from the second ink supply system. Hence, increase in the viscosity of the ink at the meniscus surface 151*a* can be prevented.

Figure 15:
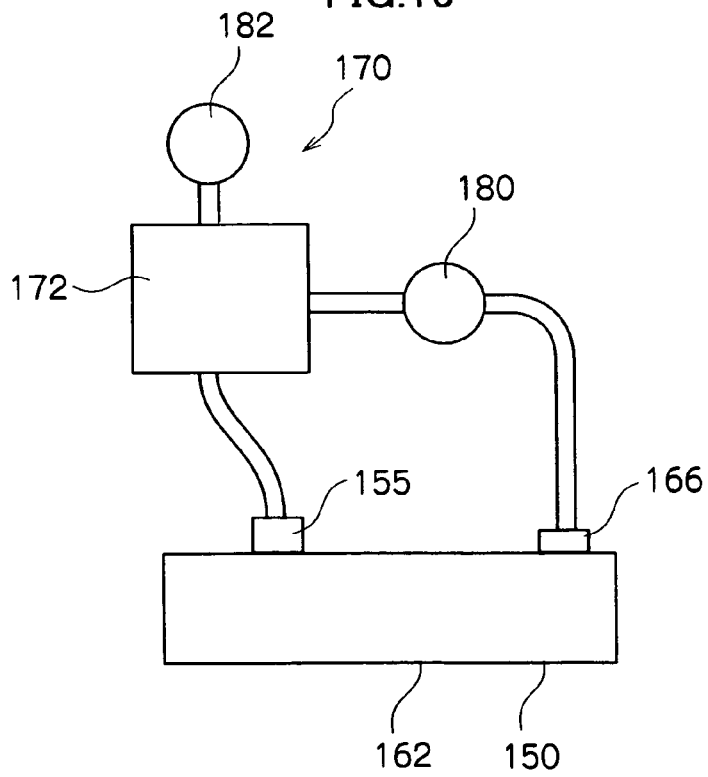
FIG. 15 is an illustrative diagram showing a further example of the composition of the pressure control device.

FIG. 15 is an illustrative diagram showing a further example of the composition of the pressure control device 170 relating to the present embodiment. The pressure control device 170 according to the present example comprises a pump 182 communicating with the ink supply tank 172, and a pump 180 communicating with the second ink supply path 166 and the ink supply tank 172.

The pump 182 controls the pressure P1 of the ink supplied to the first ink supply path 155 from the ink supply tank 172. Furthermore, the pump 180 controls the pressure P2 of the ink 169 of the second ink supply system, which is supplied to the second ink supply path 166 from the ink supply tank 172.

In order to stabilize the shape of the meniscus surface 151*a*, as described above, it is necessary to satisfy the expression (1). In other words, the pump 182 controls the pressure P1 of the ink 168 of the first ink supply system in such a manner that the ink 168 has the pressure P1 (negative pressure) lower than the pressure P2 of the ink 169 in the second ink supply system, and the pump 180 controls the pressure P2 of the ink 169 in the second ink supply system in such a manner that the ink 169 has the pressure P2 (negative pressure) equal to or lower than the atmospheric pressure P0.

As described above, in the fourth embodiment, it is possible to control the pressures P1 and P2 of the inks by the pressure control implemented by the pumps 180 and 182 in such a manner that the expression (1) is satisfied. Therefore, it is possible to generate the ink flow whereby the shape of the meniscus surface 151*a* is stabilized and new ink is constantly supplied from the second ink supply system to the meniscus surface 151*a*, and hence increase in the viscosity of the ink at the meniscus surface 151*a* can be prevented. Moreover, since foreign materials are filtered out of the supplied ink by the porous member, whereby it is possible to achieve stable discharge.

The inkjet recording head and inkjet recording apparatus according to the embodiments relate to the present invention is able to form images (including text, pictures, and the like), and three-dimensional structures containing recesses and projections created by the ink on a record paper.

The inkjet recording apparatus according to the embodiments relate to the present invention has been described in detail above, but it should be understood that there is no intention to limit the invention to the specific forms disclosed. The invention is to cover all modifications, alternate constructions and equivalents falling within the spirit and scope of the invention as expressed in the appended claims.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording head, comprising:

a pressure chamber communicating with an ink supply port and an ink discharge port;

a first supply path which supplies an ink to the pressure chamber via the ink supply port;

an orifice plate including the ink discharge port, at least an inner wall of the ink discharge port being made from a porous member capable of being impregnated with the ink;

a second supply path which supplies the ink to the porous member; and a pressure control device which controls pressure of the ink to satisfy $P1 < P2 \leqq P0$, where P1 is the pressure of the ink at a meniscus surface inside the ink discharge port, the ink being supplied from the first supply path, P2 is the pressure of the ink at a surface of the porous member forming the inner wall of the ink discharge port, the ink being supplied to the porous member from the second supply path, and P0 is an atmospheric pressure.

2. The inkjet recording head as defined in claim 1, wherein the pressure control device includes at least one of a device which adjusts a relative height of an ink surface in a tank storing the ink with respect to the inkjet recording head, and a pump.

3. An inkjet recording apparatus comprising the inkjet recording head as defined in claim 1.

* * * * *